US010302353B2

(12) United States Patent
Uchida et al.

(10) Patent No.: US 10,302,353 B2
(45) Date of Patent: May 28, 2019

(54) REFRIGERATOR, REFRIGERATOR MANAGEMENT SYSTEM, AND CONTROL METHOD FOR REFRIGERATOR

(71) Applicant: Mitsubishi Electric Corporation, Tokyo (JP)

(72) Inventors: Tsuyoshi Uchida, Tokyo (JP); Maiko Shibata, Tokyo (JP); Makoto Okabe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 149 days.

(21) Appl. No.: 15/027,001

(22) PCT Filed: Oct. 29, 2013

(86) PCT No.: PCT/JP2013/079228
§ 371 (c)(1),
(2) Date: Apr. 4, 2016

(87) PCT Pub. No.: WO2015/063855
PCT Pub. Date: May 7, 2015

(65) Prior Publication Data
US 2016/0238308 A1 Aug. 18, 2016

(51) Int. Cl.
*F25D 29/00* (2006.01)
*F25D 17/06* (2006.01)

(52) U.S. Cl.
CPC ..... *F25D 29/00* (2013.01); *F25D 17/065* (2013.01); *F25B 2600/112* (2013.01);
(Continued)

(58) Field of Classification Search
CPC .. F25D 29/00; F25D 17/065; F25D 2700/121; F25D 2600/06; F25D 2400/361; F25D 2700/02; F25B 2600/112
See application file for complete search history.

(56) References Cited

U.S. PATENT DOCUMENTS 4,197,717 A * 4/1980 Schumacher ..... F25D 21/002 62/213
4,938,027 A * 7/1990 Midlang ..... F25D 21/008 62/153

(Continued)

FOREIGN PATENT DOCUMENTS

DE 102011006258 A1 10/2012
JP 2001-099536 A 4/2001

(Continued)

OTHER PUBLICATIONS

Kamisako et al., Refrigerator, Feb. 9, 2011, JP4626716B1, Whole Document.*

(Continued)

*Primary Examiner* — Larry L Furdge
(74) *Attorney, Agent, or Firm* — Posz Law Group, PLC

(57) ABSTRACT

A refrigerator, a refrigerator management system, and a control method for a refrigerator are capable of enhancing a power-saving effect of the refrigerator. The refrigerator includes: a main body having a storage chamber; a refrigeration cycle device including a compressor and a cooler; an air blower configured to blow cooling air cooled by the cooler to the storage chamber; a blowout volume control device configured to control a blowout volume of the cooling air to be blown out to the storage chamber; input means for receiving input of schedule information that is information about a schedule of a user; storage means for storing the schedule information input into the input means; and control means for controlling at least one of the compressor, the air blower, and the blowout volume control device based on the schedule information.

15 Claims, 26 Drawing Sheets

(52) U.S. Cl.
CPC .... *F25D 2400/361* (2013.01); *F25D 2600/06* (2013.01); *F25D 2700/02* (2013.01); *F25D 2700/121* (2013.01)

(56) References Cited

U.S. PATENT DOCUMENTS

| | | | | |
|---|---|---|---|---|
| 5,224,355 | A * | 7/1993 | So | F25B 49/022 62/229 |
| 8,423,198 | B2 | 4/2013 | Wetzel et al. | |
| 2005/0040247 | A1 | 2/2005 | Pouchak | |
| 2011/0175742 | A1* | 7/2011 | Shin | F25D 17/065 340/635 |
| 2012/0260677 | A1* | 10/2012 | Ozawa | F25D 29/00 62/56 |
| 2012/0260683 | A1 | 10/2012 | Cheon et al. | |

FOREIGN PATENT DOCUMENTS

| | | | |
|---|---|---|---|
| JP | 2005-20989 | A | 1/2005 |
| JP | 4626716 | B1 * | 2/2011 |
| JP | 2011-208906 | A | 10/2011 |
| JP | 2011-208907 | A | 10/2011 |
| JP | 2012-220186 | A | 11/2012 |
| JP | 2012-242074 | A | 12/2012 |
| JP | 2013-108739 | A | 6/2013 |
| JP | 2013-170759 | A | 9/2013 |

OTHER PUBLICATIONS

International Preliminary Report on Patentability dated May 12, 2016 in corresponding international application No. PCT/JP2013/079228 (English translation only).
Extended European search report dated Aug. 30, 2017 issued in corresponding EP application No. 13896539.7.
International Search Report of the International Searching Authority dated Jan. 28, 2014 for the corresponding International application No. PCT/JP2013/079228 (and English translation).
Office Action dated Aug. 18, 2015 issued in corresponding TW patent application No. 104210933390 (and partial English translation).
Office Action dated Mar. 1, 2017 issued in the corresponding CN application No. 201380080636.5 (and partial English translation).
Partial supplementary European search report dated May 4, 2017 in the corresponding EP patent application No. 13 896 539.7.
Office Action dated Jun. 15, 2017 issued in the corresponding CN application No. 201380080636.5 (and partial English translation).
Office Action dated Jan. 23, 2018 issued in corresponding JP patent application No. 2017-075140 (and English machine translation thereof).
Office Action dated Aug. 14, 2018 issued in corresponding EP patent application No. 13896539.7.
Office action dated Mar. 20, 2019 issued in corresponding EP patent application No. 13896539.7.

* cited by examiner (a) MONTHLY DISPLAY (b) WEEKLY DISPLAY (c) DAILY DISPLAY (a) MAIN TEMPERATURES AND POWER CONSUMPTION (b) SHELF TEMPERATURES IN COLD STORAGE CHAMBER (c) DOOR SHELF TEMPERATURES IN COLD STORAGE CHAMBER (d) DIFFERENTIAL PRESSURE BETWEEN INSIDE AND OUTSIDE OF COLD STORAGE CHAMBER (a) MAIN TEMPERATURES AND POWER CONSUMPTION (b) SHELF TEMPERATURES IN COLD STORAGE CHAMBER

REFRIGERATOR, REFRIGERATOR MANAGEMENT SYSTEM, AND CONTROL METHOD FOR REFRIGERATOR

CROSS REFERENCE TO RELATED APPLICATION

This application is a U.S. national stage application of International Application No. PCT/JP2013/079228 filed on Oct. 29, 2013, the disclosure of which is incorporated herein by reference.

TECHNICAL FIELD

The present invention relates to a refrigerator, a refrigerator management system, and a control method for a refrigerator.

BACKGROUND ART

A refrigerator capable of setting a quick freezing mode used for quick-freezing of a freezing chamber is disclosed in Patent Literature 1. In the disclosed refrigerator, the quick freezing mode is prohibited when a specified time period, which is set in advance, is detected and an ambient temperature around the exterior of the refrigerator is equal to or above a predetermined temperature. The invention disclosed in Patent Literature 1 aims at power saving in the time period when power usage is at its peak.

CITATION LIST

Patent Literature

Patent Literature 1

Japanese Patent Laid-Open No. 2013-170759 (paragraphs 0005 and 0006, FIG. 2)

SUMMARY OF INVENTION

Technical Problem

In the refrigerator disclosed in Patent Literature 1, power-saving operation is performed only in the time period when the power usage is at its peak. Accordingly, the amount of power-saving in the refrigerator is limited, which causes an insufficient power-saving effect.

The present invention has been made to solve the above-stated problem, and it is therefore an object of the present invention to provide a refrigerator, a refrigerator management system, and a control method for a refrigerator, capable of enhancing the power-saving effect of the refrigerator.

Solution to Problem

A refrigerator of the invention includes: a main body having a storage chamber; a refrigeration cycle device including a compressor and a cooler; an air blower configured to blow cooling air cooled by the cooler to the storage chamber, a blowout volume control device configured to control a blowout volume of the cooling air to be blown out to the storage chamber, input means for receiving input of schedule information that is information about a schedule of a user; storage means for storing the schedule information input into the input means; and control means for controlling at least one of the compressor, the air blower, and the blowout volume control device based on the schedule information.

A control method of the invention for a refrigerator including: a main body having a storage chamber; a refrigeration cycle device including a compressor and a cooler; an air blower configured to blow cooling air cooled by the cooler to the storage chamber; a blowout volume control device configured to control a blowout volume of the cooling air to be blown out to the storage chamber; and input means for receiving input of schedule information on a user, includes the steps of: inputting the schedule information on the user into the input means; storing the schedule information input into the input means; and controlling at least one of the compressor, the air blower, and the blowout volume control device based on the schedule information.

Advantageous Effects of Invention

According to the present invention, it becomes possible to appropriately control at least one of a compressor, an air blower, and a blowout volume control device of a refrigerator in accordance with a schedule of a user, so that the power-saving effect of the refrigerator can be enhanced.

DESCRIPTION OF EMBODIMENTS

Hereinafter, embodiments of the present invention will be described with reference to the drawings. It is to be noted that like component members are designated by like reference signs to omit redundant description. The present invention includes all the combinations of each embodiment described hereinbelow.

First Embodiment

Figure 1:
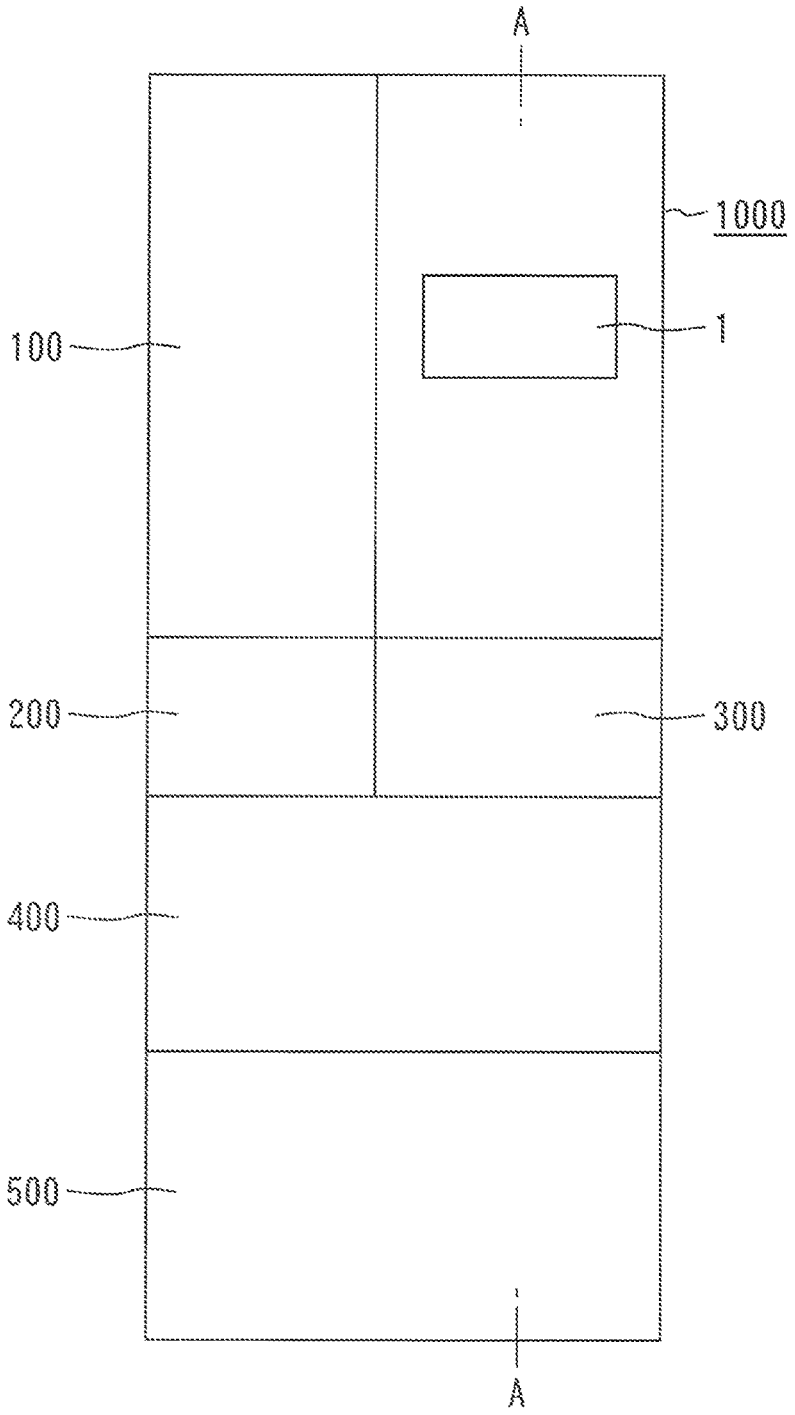
FIG. 1 is a front view illustrating an external appearance of a refrigerator of a first embodiment of the present invention.
Figure 2:
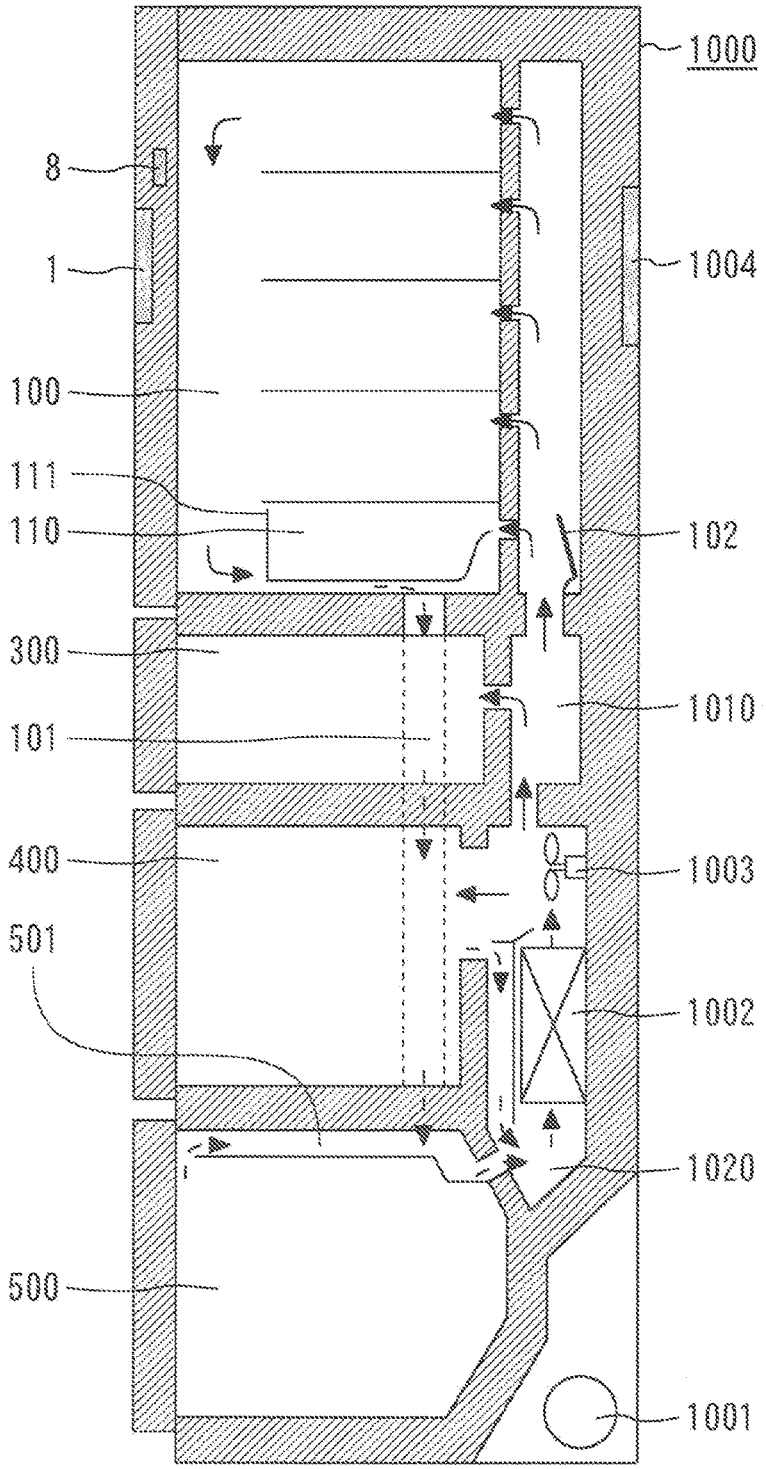
FIG. 2 is a sectional side view of the refrigerator of the first embodiment of the present invention taken along an A-A line in FIG. 1.

FIG. 1 is a front view illustrating an external appearance of a refrigerator of a first embodiment of the present invention. FIG. 2 is a sectional side view of the refrigerator of the first embodiment of the present invention taken along an A-A line in FIG. 1. As illustrated in FIGS. 1 and 2, a main body or a casing of the refrigerator 1000 of the first embodiment has a plurality of storage chambers. The storage chambers include a cold storage chamber 100, an ice making chamber 200, a switching chamber 300, a freezing chamber 400, and a vegetable chamber 500. The cold storage chamber 100 is arranged on the top. Under the cold storage chamber 100, the ice making chamber 200 and the switching chamber 300 are arranged. Under these chambers, the freezing chamber 400 is arranged, and under the freezing chamber 400, the vegetable chamber 500 is arranged. The cold storage chamber 100, the ice making chamber 200, the switching chamber 300, the freezing chamber 400, and the vegetable chamber 500 have doors individually provided for opening and closing their respective front opening portions. The cold storage chamber 100 has a double door which opens outward. The ice making chamber 200, the switching chamber 300, the freezing chamber 400, and the vegetable chamber 500 are formed to be drawable toward the front side of the refrigerator 1000 in unison with the individual doors of the respective chambers.

As illustrated in FIG. 2, a chilled room 110 is provided in a lowermost stage inside the cold storage chamber 100. The chilled room 110 is structured by a chilled case 111. The chilled case 111 is formed to be drawable toward the door of the cold storage chamber 100 with the aid of guide implements such as rails (illustration omitted).

The main body of the refrigerator 1000 is provided with a refrigeration cycle circuit configured to cool the air supplied to each of the storage chambers. Inside the main body of the refrigerator 1000, an air duct is formed for supplying cooling air cooled by the refrigeration cycle circuit to each of the storage chambers.

The refrigeration cycle circuit includes a compressor 1001, a condenser (illustration omitted) for condensing refrigerant discharged from the compressor 1001, a throttle device (illustration omitted) for expanding the refrigerant flowing out of the condenser, a cooler (evaporator) 1002 for cooling the air to be supplied to each of the storage chambers with the refrigerant expanded by the throttle device, and the like. As the refrigeration cycle circuit, a generally known refrigeration cycle circuit may be used.

In the first embodiment, the compressor 1001 is arranged in a lower portion on a back surface side of the main body of the refrigerator 1000. The cooler 1002 is provided in a later-described cooling air duct 1010. The cooling air duct 1010 is also equipped with an air blower 1003 for sending the cooling air cooled by the cooler 1002 to each of the storage chambers. In other words, the air blower 1003 is adapted to circulate the cooling air inside the main body of the refrigerator 1000.

The air duct for supplying the cooling air, which is cooled by the refrigeration cycle circuit, to each of the storage chambers includes a cooling air duct 1010, a return air duct 1020, a cold storage chamber return air duct 101, and a vegetable chamber return air duct 501. In the first embodiment, the cooling air duct 1010 is formed in a back surface portion of the main body of the refrigerator 1000. The cooling air duct 1010 is an air passage duct for sending the cooling air cooled by the cooler 1002 to each of the storage chambers. The refrigerator 1000 has a blowout volume control device configured to control a flow rate, i.e., a blowout volume, of cooling air to each of the storage chambers. In the first embodiment, a cold storage chamber damper 102 is provided in the cooling air duct 1010 as a blowout volume control device configured to control the blowout volume of cooling air to the cold storage chamber 100. If an opening ratio of the cold storage chamber damper 102 is reduced, the blowout volume of the cooling air to the cold storage chamber 100 lowers. If the opening ratio of the cold storage chamber damper 102 is increased, the blowout volume of the cooling air to the cold storage chamber 100 increases. Although only the cold storage chamber damper 102 is illustrated as a blowout volume control device in FIG. 2, the refrigerator 1000 further includes blowout volume control devices (illustration omitted), such as dampers that control the blowout volume of cooling air to each of the storage chambers other than the cold storage chamber 100.

The return air duct 1020 is an air passage duct that sends the cooling air, which has cooled each of the storage chambers, to the cooler 1002. The cold storage chamber return air duct 101 is an air passage duct that sends the cooling air, which has cooled the cold storage chamber 100 and the chilled room 110, to the vegetable chamber 500. The cooling air which has cooled the cold storage chamber 100 and the chilled room 110 is mixed, in the vegetable chamber return air duct 501, with the cooling air which has cooled the vegetable chamber 500. The mixed cooling air is then blown to the cooler 1002.

The refrigerator 1000 is equipped with a door opening and closing detection means 8 for detecting opening and closing of the door of the cold storage chamber 100. A later-described controller 1004 uses the door opening and closing detection means 8 to detect opening and closing of the door of the cold storage chamber 100. The controller 1004 may perform control to inform users that the door is left open, when the door continues to be in an opened state for preset time limit or more. The time limit may be, for example, 1 minute, and be more than 1 minute or less than 1 minute. The time limit may arbitrarily be set by the users. The door opening and closing detection means 8 may be provided so as to detect opening and closing of the door of another storage chamber other than the cold storage chamber 100. The refrigerator 1000 may include the door opening and closing detection means 8 for all the storage chambers of the refrigerator 1000.

The refrigerator 1000 has an operation panel 1. In FIG. 2, the operation panel 1 is provided on the door of the cold storage chamber 100. As described later, the operation panel 1 has an input means 9 and a displaying means 10. The operation panel 1 may be provided at positions other than the door of the cold storage chamber 100. The operation panel 1 may be provided on the door of another storage chamber, or on a side surface of the main body of the refrigerator 1000. Both or one of the input means 9 and the displaying means 10 of the operation panel 1 may be provided separately from the main body of the refrigerator 1000. In that case, both or one of the input means 9 and the displaying means 10 of the operation panel 1 may be configured to be attachable to or detachable from the main body of the refrigerator 1000. Or both or one of the input means 9 and the displaying means 10 of the operation panel 1 may be configured to be unmountable on the main body of the refrigerator 1000. When both or one of the input means 9 and the displaying means 10 of the operation panel 1 is provided separately from the main body of the refrigerator 1000, both or one of the input means 9 and the displaying means 10 of the operation panel 1 communicate with the controller 1004 in a wired or wireless manner.

The controller 1004 is provided on the back surface of the main body of the refrigerator 1000. The controller 1004 controls operation of the compressor 1001, operation of the air blower 1003, and operation of the blowout volume control devices of the respective storage chambers including the cold storage chamber damper 102, based on a preinstalled program. In the following description, the blowout volume control devices for the respective storage chambers including the cold storage chamber damper 102, and the blowout volume control devices for the storage chambers other than the cold storage chamber 100 are generically referred to as "blowout volume control devices" or "dampers". Only the blowout volume control device for the cold storage chamber 100, i.e., the cold storage chamber damper 102 itself, is referred to as "a cold storage chamber damper 102".

Figure 3:
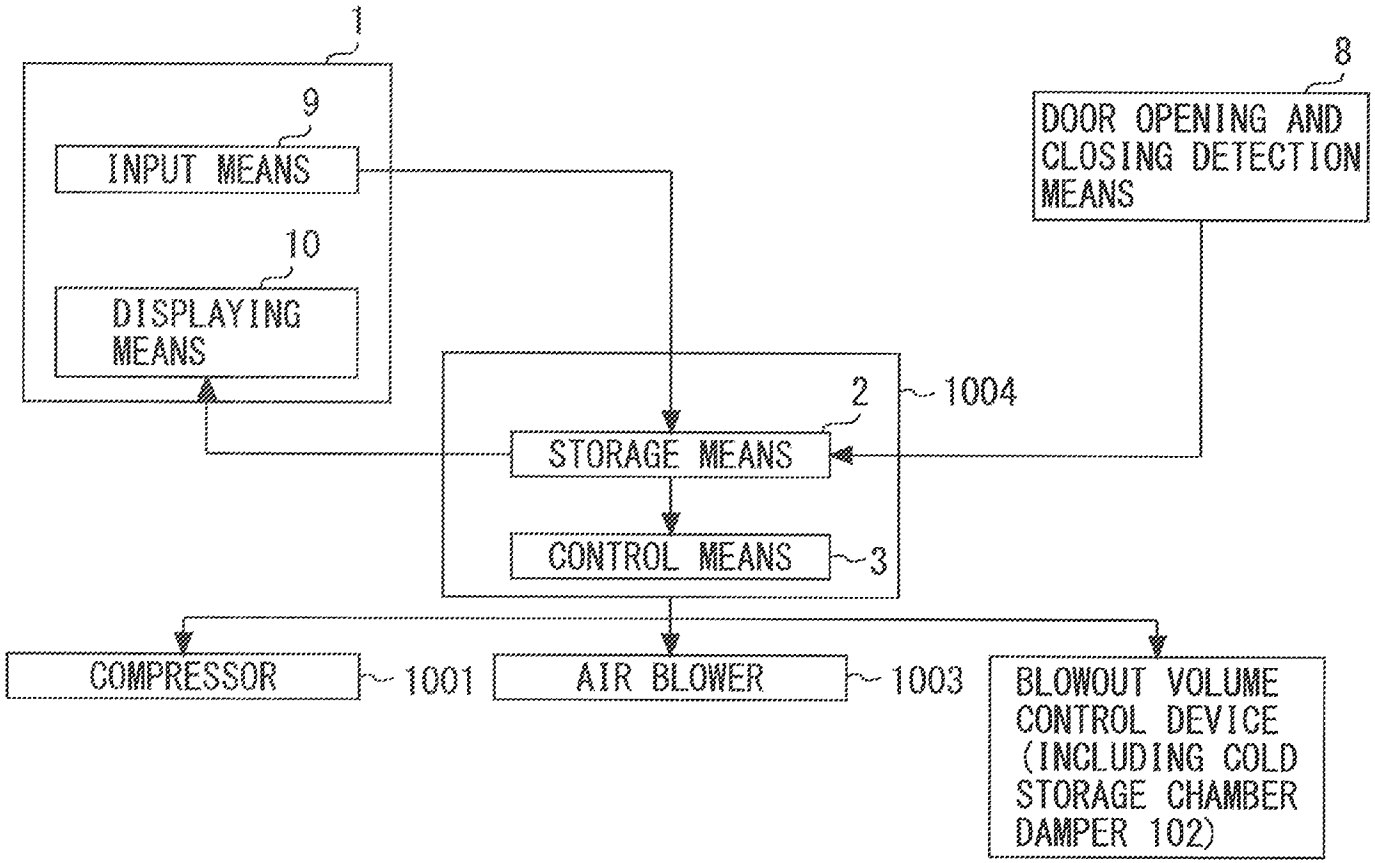
FIG. 3 is a functional block diagram of the refrigerator of the first embodiment of the present invention.

FIG. 3 is a functional block diagram of the refrigerator 1000 of the first embodiment of the present invention. As illustrated in FIG. 3, the operation panel 1 has an input means 9 for receiving information inputting operation by the users, and a displaying means 10 for displaying information. The users can input into the input means 9 information about a set temperature of each of the storage chambers, and schedule information that is information about schedules of the users. The controller 1004 has a storage means 2 and a control means 3. The storage means 2 can communicate with the control means 3. The storage means 2 receives a detection signal of the door opening and closing detection means 8. The storage means 2 is further connected with the input means 9 and the displaying means 10 of the operation panel 1 in a communicable manner. The storage means 2 receives the information (for example, a set temperature of each of the storage chambers) about a set temperature of each of the storage chambers input by the input means 9 and the schedule information on the users, and stores these pieces of information. The displaying means 10 can display information on current temperature of each of the storage chambers, and the schedule information on the users stored by the storage means 2.

The control means 3 is electrically connected with each of the compressor 1001, the air blower 1003, and the blowout volume control devices. The control means 3 receives the schedule information on the users from the storage means 2. The control means 3 sends a control signal necessary for controlling the inside temperature of each storage chamber to the compressor 1001, the air blower 1003, and the blowout volume control devices, based on the schedule information on the users received from the storage means 2. The control means 3 controls the compressor 1001, the air blower 1003, and the blowout volume control devices so as to enhance or reduce cooling of each of the storage chambers based on the schedule information on the users and on the preinstalled program.

The storage means 2 stores information on opening and closing of the door detected by the door opening and closing detection means 8. The storage means 2 stores information about a past record of opening and closing of the door detected by the door opening and closing detection means 8. These pieces of information are hereinafter referred to as "door opening and closing information." The storage means 2 transmits the door opening and closing information to the control means 3. In the first embodiment, the control means 3 controls the compressor 1001, the air blower 1003, and the blowout volume control devices based on the schedule information on the users and the door opening and closing information. However, in the present invention, the compressor 1001, the air blower 1003, and the blowout volume control devices may be controlled based on the schedule information on the users without using the door opening and closing information.

Figure 4:
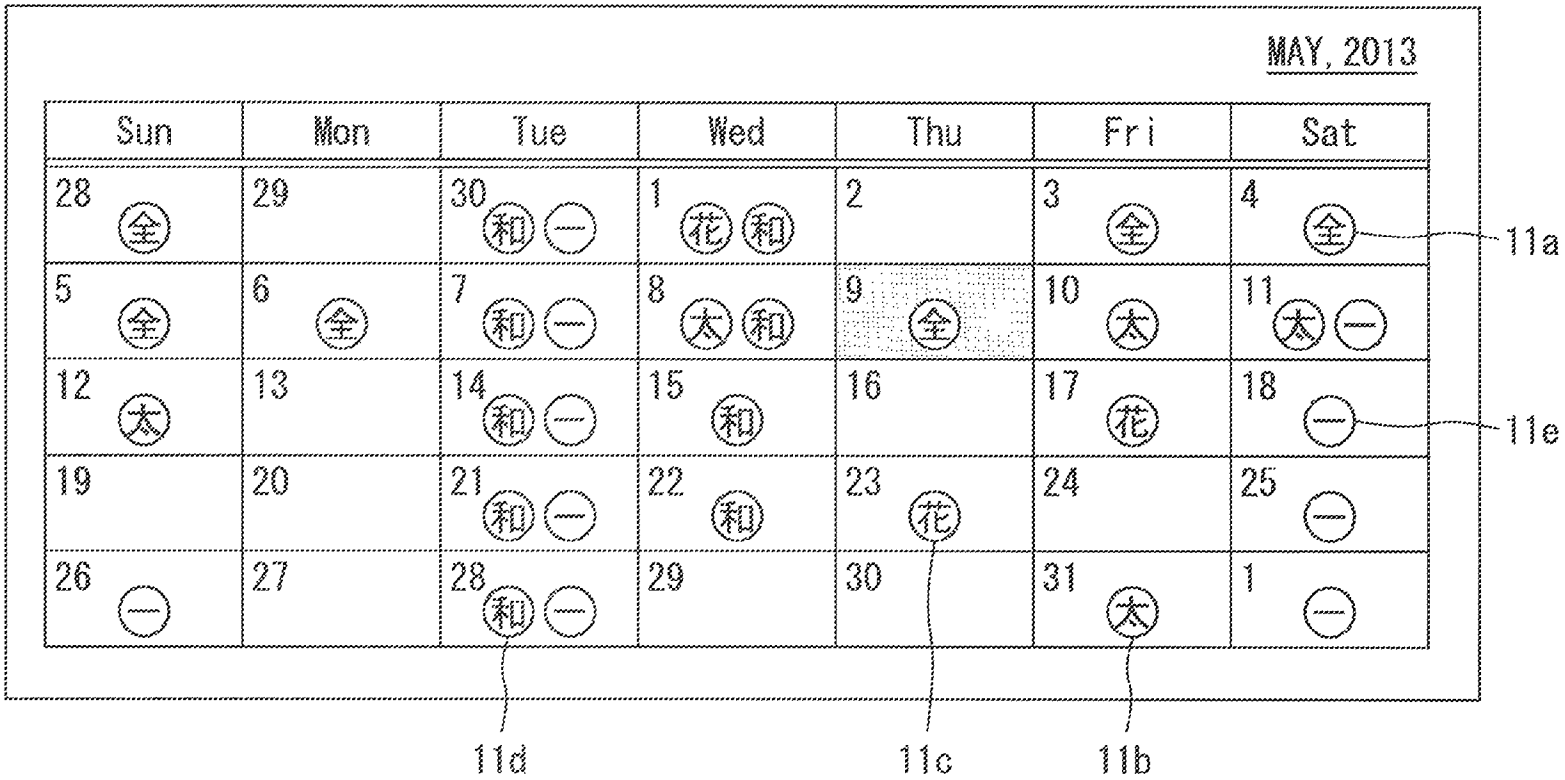
FIG. 4 illustrates one example of a display screen (monthly display) of a displaying means, which displays schedule information on users, in the refrigerator of the first embodiment.
Figure 5:
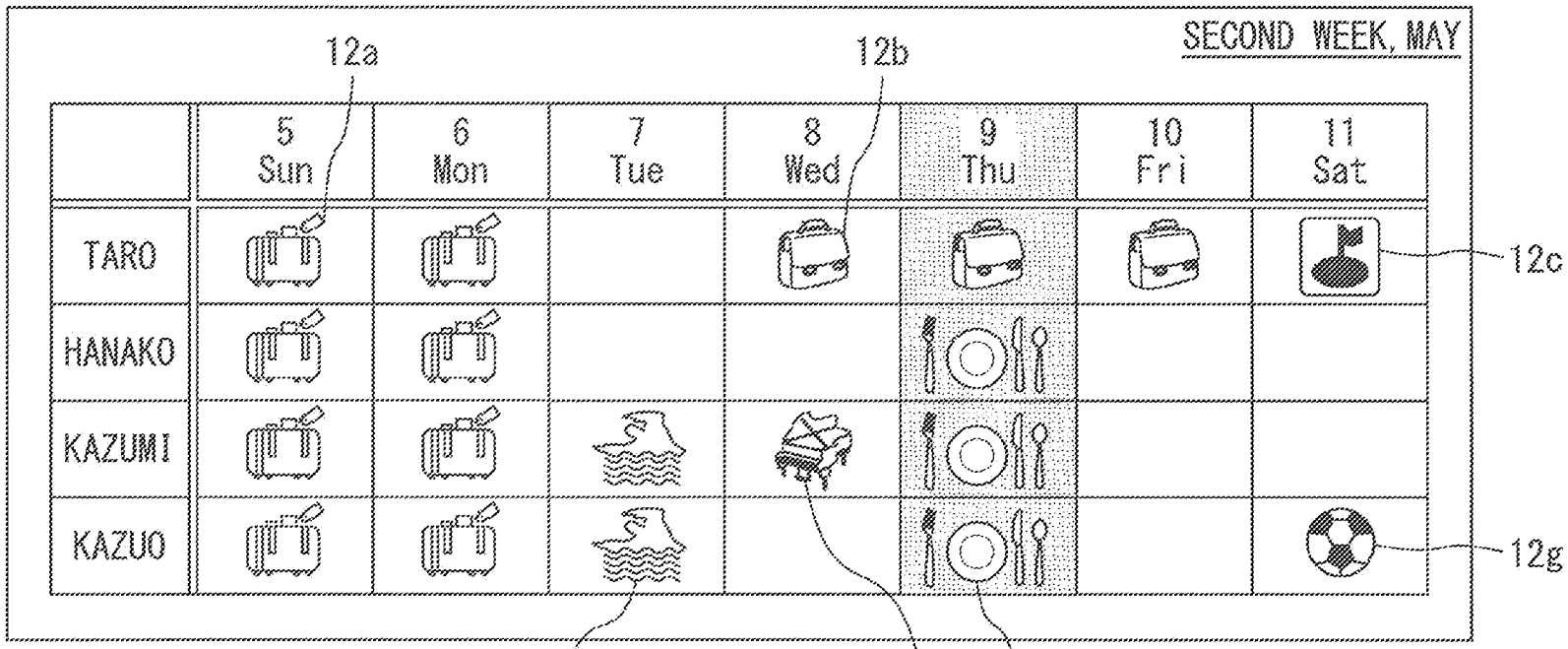
FIG. 5 illustrates one example of a display screen (weekly display) of a displaying means, which displays schedule information on users, in the refrigerator of the first embodiment.
Figure 6:
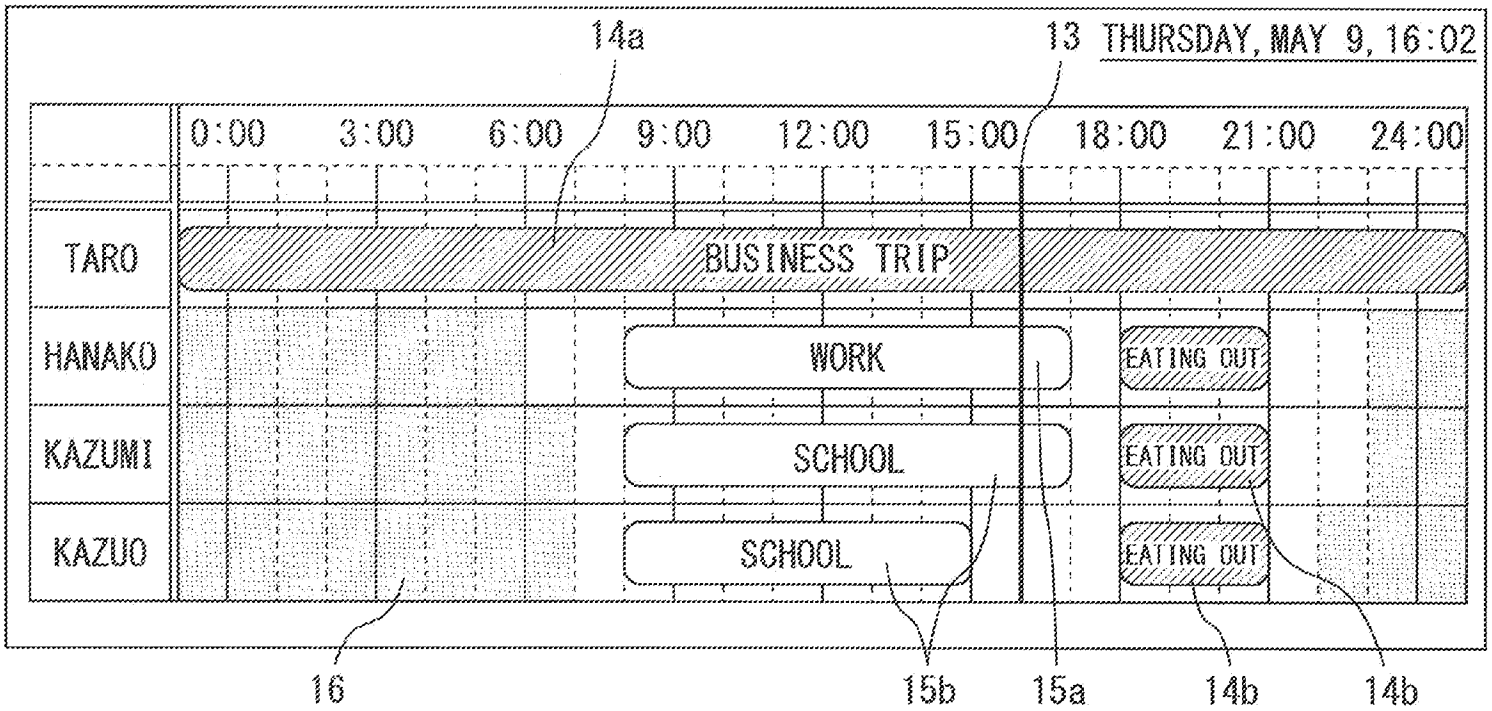
FIG. 6 illustrates one example of a display screen (daily display) of a displaying means, which displays schedule information on users, in the refrigerator of the first embodiment.

FIGS. 4 to 6 each illustrate one example of a display screen of the displaying means 10, which displays schedule information on the users, in the refrigerator 1000 of the first embodiment. The storage means 2 stores the schedule information on the users input by the input means 9 and manages the data. FIGS. 4 to 6 illustrate imitated screens displayed by the displaying means 10 of the operation panel 1 based on the data on the schedule information stored and managed by the storage means 2.

FIG. 4 is a monthly schedule display screen, FIG. 5 is a weekly schedule display screen, and FIG. 6 is a daily schedule display screen. In FIGS. 4 to 6, four persons in a general double-income family are assumed as users. The family of four persons includes a father Taro, a mother Hanako, an eldest daughter Kazumi, and an eldest son Kazuo.

In the monthly display of FIG. 4, a mark 11*a* indicates that all the users have schedules. A mark 11*b* represents a schedule of the father Taro. A mark 11*c* represents the schedule of the mother Hanako. A mark 11*d* represents the schedule of the eldest daughter Kazumi. A mark 11*e* represents the schedule of the eldest son Kazuo.

In the weekly display of FIG. 5, marks 12*a* to 12*g* represent the contents of the schedules. The schedule mark 12*a* represents a travel. The schedule mark 12*b* represents a business trip. The schedule mark 12*c* represents a golf. The schedule mark 12*d* represents an eating out. The schedule mark 12*e* represents a swimming (lesson). The schedule mark 12*f* represents a piano (lesson). The schedule mark 12*g* represents a soccer (lesson).

In the daily display of FIG. 6, a mark 13 represents current time. Marks 14*a* and 14*b* represent time periods scheduled for irregular outing of users. The mark 14*a* represents a time period scheduled for a business trip (irregular outing). In FIG. 6, the father Taro is scheduled to have a business trip all day. The mark 14*b* represents a time period scheduled for eating out (irregular outing). FIG. 6 indicates that the mother Hanako, the eldest daughter Kazumi, and the eldest son Kazuo are scheduled to eat out from 18:00 to 21:00. Marks 15*a* and 15*b* represent time periods scheduled for regular outing of the users. The mark 15*a* represents a time period scheduled for work (regular outing). FIG. 6 indicates that the mother Hanako is scheduled to go to work from 8:00 to 18:00. The mark 15*b* represents a time period scheduled for school (regular outing). FIG. 6 indicates that the eldest daughter Kazumi is scheduled to go to school from 8:00 to 18:00 and the eldest son Kazuo is scheduled to go to school from 8:00 to 15:00. A mark 16 represents a time period when the users are scheduled to sleep. FIG. 6 indicates that the mother Hanako is scheduled to sleep from 23:00 to 6:00, the eldest daughter Kazumi is scheduled to sleep from 23:00 to 7:00, and the eldest son Kazuo is scheduled to sleep from 22:00 to 7:00. In the aforementioned example, the time periods when the users are scheduled to sleep and the time periods when the users are scheduled to have regular outing correspond to the information about life patterns of the users.

A description is now given of one example of the operation of the refrigerator 1000 of the first embodiment with reference to FIGS. 1 to 6. In FIG. 2, the cooling air cooled by the cooler 1002 is blown to each of the storage chambers by the air blower 1003 via the cooling air duct 1010. Then, the air which cooled each of the storage chambers returns as return air to the cooler 1002 again via the return air duct 1020, which results in forming a circulating air duct. In this operation, the cooling air cooled by the cooler 1002 is distributed to each of the storage chambers to cool the respective storage chambers. By opening and closing control of a plurality of dampers including the cold storage chamber damper 102, a flow rate, i.e., a blowout volume, of the cooling air to each of the storage chambers is controlled. As a result, temperatures of the storage chambers are individually set. The cooling air cooled by the cooler 1002 is in a temperature range of, for example, −30° C. to −25° C.

For example, the damper for the freezing chamber 400 which is set at a lowest temperature (for example, −22° C. to −16° C.) is set to be generally fully opened, while the damper for the vegetable chamber 500 which is set at a highest temperature (for example, 3° C. to 9° C.) is set to be generally fully closed. The vegetable chamber 500 is indirectly cooled with the return air which has cooled the cold storage chamber 100 and the chilled room 110 whose set temperatures are lower (for example, 0° C. to 6° C. and 0° C. to 2° C., respectively) than that of the vegetable chamber 500. Thus, the set temperature of each of the storage chambers is controlled.

Here, to cope with overcooling or undercooling of each of the storage chambers, the set temperature of each of the storage chambers can be adjusted in the range of about ±2° C. to ±3° C. For example, the set temperature of the freezing chamber 400 can be changed in the range of about −25° C. to −13° C., and the set temperature of the cold storage chamber 100 can be changed in the range of about −2° C. to 9° C. When a specific storage chamber is undercooled, cooling enhancement control is performed by lowering the set temperature of the storage chamber. For example, in the case of enhancing cooling of only the cold storage chamber 100, the opening ratio of the cold storage chamber damper 102 is set larger so as to increase the flow rate, i.e., the blowout volume, of the cooling air to the cold storage chamber 100. When it is necessary to enhance cooling of a plurality of storage chambers, both or one of the rotation speed of the compressor 1001 and the air blow volume of the air blower 1003 are increased so as to enhance cooling capacity of the refrigeration cycle. This results in increase in power consumption of the refrigerator 1000.

On the contrary, when a specific storage chamber is overcooled, the set temperature of the storage chamber is set higher to reduce cooling, i.e., to decrease cooling. In that case, the opening ratio of the damper for the storage chamber is made smaller to decrease the flow rate, i.e., the blowout volume, of the cooling air. In the case of reducing cooling of a plurality of storage chambers, both or one of the rotation speed of the compressor 1001 and the air blow volume of the air blower 1003 is reduced, so that the power consumption of the refrigerator 1000 decreases.

The power consumption of the refrigerator 1000 is lower than other home electric appliances, such as room air conditioners and IH cooking heaters. However, since the refrigerator 1000 stores food and drink, it is unacceptable to stop cooling, that is, to turn off the refrigerator 1000. Accordingly, in order to perform power-saving operation of the refrigerator 1000, it is necessary to increase the set temperature of each of the storage chambers in accordance with use conditions by users and storage states of food and drink. For example, in such a case where the frequency of opening and closing the door, which triggers rapid cooling operation, is low or the amount of food and drink stored in the storage chamber is small, power-saving operation can be performed without spoiling the preservation quality of the food and drink even with the increased set temperature.

Accordingly, in the first embodiment, as illustrated in FIG. 3, the storage means 2 stores the schedule information on the users input with the operation panel 1, and the control means 3 controls the compressor 1001, the air blower 1003, and the blowout volume control devices based on the schedule information. As a result, it becomes possible to change the set temperature of each of the storage chambers.

Based on the schedule information on the users illustrated in FIGS. 4 to 6, the following control is performed for example. First, a control example in units of several days will be described. According to monthly display of FIG. 4 and weekly display of FIG. 5, all the users are scheduled to go out and be absent due to a travel from May 3 to May 6. More specifically, in the period from May 3 to May 6, it is ensured that the amount of food and drink in the refrigerator 1000 does not increase and that the doors of the refrigerator 1000 are not opened and closed. Accordingly, during the period from May 3 to May 6, the control means 3 performs cooling reduction control that decreases both or one of the rotation speed of the compressor 1001 and the air blow volume of the air blower 1003 as compared with those in the normal operation. Accordingly, it becomes possible to execute the power-saving operation that can provide a higher power-saving amount while maintaining the preservation quality of the food and drink. Similar cooling reduction control, i.e., power-saving operation, may be performed not only when all the users are absent but also when a part of the users is/are absent. In that case, a margin of decrease of both or one of the rotation speed of the compressor 1001 and the air blow volume of the air blower 1003 may be set larger as more users are absent.

Next, a control example on a daily basis will be described. In the daily display of FIG. 6, all the users are scheduled to go out and be absent in the time periods of 8:00 to 15:00, and 18:00 to 21:00, and all the users are scheduled to sleep in the time period of 23:00 to 6:00. In these time periods, the doors of the refrigerator 1000 are not opened and closed except for unexpected cases. Examples of the unexpected cases include a case where any of the users becomes sick outside and unpredictably comes back home and a case where any of the users gets up in the middle of night to take drink out of the refrigerator. The control means 3 performs cooling reduction control which decreases both or one of the rotation speed of the compressor 1001 and the air blow amount of the air blower 1003 as compared with those in the normal operation, during the time period when all the users are scheduled to go out and be absent and the time period when all the users are scheduled to sleep. Accordingly, it becomes possible to execute the power-saving operation that can provide a higher power-saving amount while maintaining the preservation quality of the food and drink. Similar cooling reduction control that is power-saving operation may be performed not only when all the users go out or sleep but also when a part of the users goes/go out or sleeps/sleep. In that case, the margin of decrease of both or one of the rotation speed of the compressor 1001 and the air blow volume of the air blower 1003 may be set larger as more users go out or sleep.

As described before, reflecting the schedule information on the users upon the cooling control of the refrigerator 1000 makes it possible to perform power-saving operation that is adapted for the life patterns of the users and that can provide a higher power-saving amount on a time basis.

In the refrigerator 1000 that preserves food and drink, the life patterns to be reflected by the storage means 2 upon the cooling control include not only the individual acts of each user, such as routine outing, sleeping, and getting up, but also a purchasing pattern of a user household, i.e., food and drink purchasing schedule information, and this information serves as an important control factor. When the user household purchases food and drink, the doors of the refrigerator 1000 are opened to put the purchased food and drink into the refrigerator 1000. This causes increase in temperature inside the storage chambers and triggers rapid cooling operation.

Accordingly, in the first embodiment, the storage means 2 stores as schedule information the purchasing pattern of the user household in addition to the individual schedule information on the users illustrated in FIGS. 4 to 6. Double-income households tend to make a bulk purchase in the weekend. The households with full-time homemakers tend to make a purchase every day. Based on the information input into the input means 9, the storage means 2 stores purchasing patterns such as a pattern of making a bulk purchase in the weekend, a pattern of making a purchase every day, or a pattern of making a purchase with a period shorter than one week (for example, every other day) as a purchasing pattern. The storage means 2 may prestore a plurality of purchasing pattern choices as described above and may enable the users to select a purchasing pattern from those choices with the input means 9.

When the user household has the pattern of making a bulk purchase in the weekend, the doors of the refrigerator 1000 are frequently opened and closed, and also the storage amount of food and drink increases in the weekend. Therefore, it is desirable to enhance cooling in the weekend. In this connection, when the user household has the purchasing pattern of making a bulk purchase in the weekend, the control means 3 makes the set temperatures of the storage chambers during the weekend lower than those on weekdays to enhance cooling. Since a purchase is not made on weekdays, the doors of the refrigerator 1000 are opened and closed less frequently on weekdays. Accordingly, on weekdays, the control means 3 sets the set temperatures of the storage chambers higher than those in the weekend to reduce cooling. This makes it possible to save power while maintaining the preservation quality of food and drink. On weekdays, as the weekend approaches, the food and drink stored in the refrigerator 1000 reduce and a load of cooling the food and drink decreases. Accordingly, on weekdays, the control means 3 gradually changes the set temperature of each of the storage chambers to be higher toward the weekend. This makes it possible to achieve further power-saving while maintaining the preservation quality of food and drink.

When the user household has a purchasing pattern of making a purchase with a period shorter than one week, the control means 3 sets the set temperature of each of the storage chambers lower on the purchasing scheduled days than the set temperature on other days to enhance cooling. As described in the foregoing, the frequency of opening and closing the doors of the refrigerator 1000 and the storage amount of food and drink can be estimated based on the purchasing pattern of the user household. Therefore, changing cooling control based on the purchasing pattern of the user household makes it possible to prevent overcooling and undercooling to achieve efficient cooling. Since effective cooling operation can be performed, a high power-saving effect can be obtained.

Figure 7:
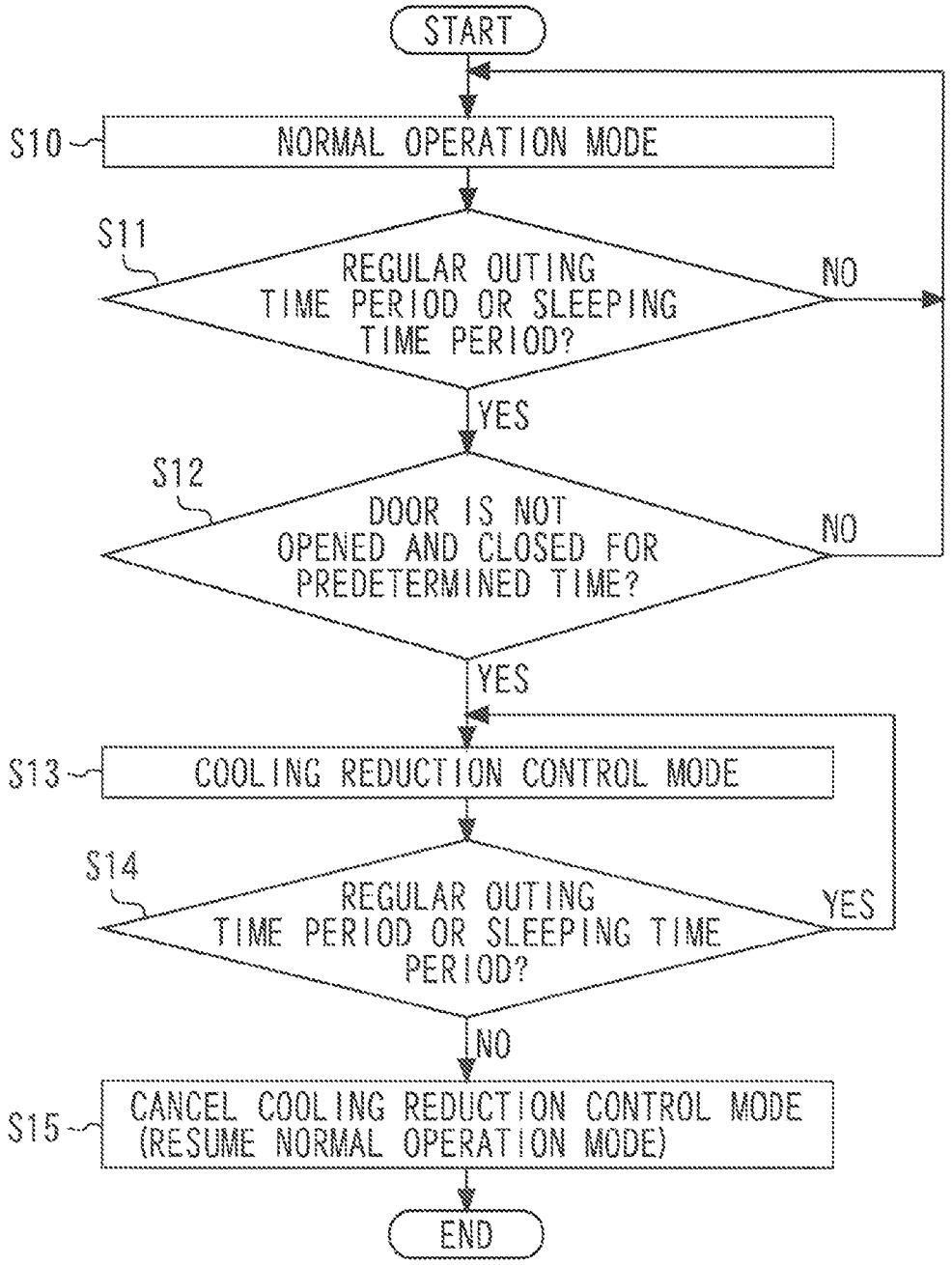
FIG. 7 is a flowchart illustrating control of the refrigerator of the first embodiment of the present invention.

FIG. 7 is a flowchart illustrating control of the refrigerator 1000 of the first embodiment of the present invention. Operation of the first embodiment will be described with reference to the flow chart illustrated in FIG. 7.

In step S10, the refrigerator 1000, which is in a normal cooling operation mode, performs normal cooling operation. During the normal cooling operation, the control means 3 determines, based on the schedule information stored in the storage means 2, whether or not the present moment corresponds to a time period when the users are scheduled to go for a regular outing or to a time period when the users are scheduled to sleep (step S11). The time period when the users are scheduled to go for a regular outing is hereinafter called "a regular outing time period", and the time period when the users are scheduled to sleep is hereinafter called "a sleeping time period." In the first embodiment, when the present moment corresponds to the time period when the regular outing time periods or the sleeping time periods of all the users overlap, the control means 3 determines that the present moment corresponds to the regular outing time period or the sleeping time period. However, in the present invention, when the present moment corresponds to the regular outing time period(s) or the sleeping time period(s) of a part of the users, the control means 3 may determine that the present moment corresponds to the regular outing time period or the sleeping time period.

When the control means 3 determines that the present moment does not correspond to the regular outing time period or the sleeping time period, the control means 3 returns to the first step S10, and continues the normal cooling operation (NO in step S11).

On the contrary, when the control means 3 determines that the present moment corresponds to the regular outing time period or the sleeping time period (YES in step S11), the processing proceeds to step S12. In step S12, the control means 3 determines whether continuation time of the doors of the refrigerator 1000 being in a closed state reached preset time. Hereinafter, the preset time is called "predetermined time." In other words, the control means 3 determines in step S12 whether or not any door of the refrigerator 1000 was opened and closed within past predetermined time based on the door opening and closing information.

When the control means 3 determines in step S12 that the continuation time of the doors of the refrigerator 1000 being in the closed state has not reached the predetermined time, i.e., when the control means 3 determines that there is record of any door of the refrigerator 1000 being opened and closed within the past predetermined time, the processing returns to the first step S10 and the normal cooling operation is continued (NO in step S12).

On the contrary, when the control means 3 determines in step S12 that the continuation time of any door of the refrigerator 1000 being in the closed state has reached the predetermined time, i.e., when the control means 3 determines that there is no record of any door of the refrigerator 1000 being opened and closed within the past predetermined time (YES in step S12), the control means 3 sets a cooling reduction control mode which controls at least one of the compressor 1001, the air blower 1003, and the blowout volume control devices so as to reduce cooling of the storage chambers of the refrigerator 1000 (step S13). Here, the predetermined time is, for example, 30 minutes, though it may be shorter or longer than 30 minutes. The predetermined period may arbitrarily be set by the users.

When the cooling reduction control mode is applied to one specific storage chamber, the opening ratio of a damper that is a blowout volume control device for that storage chamber is made smaller so as to decrease the flow rate, i.e., the blowout volume of cooling air. When the cooling reduction control mode is applied to a plurality of storage chambers, both or one of the rotation speed of the compressor 1001 and the air blow volume of the air blower 1003 is decreased, so that the power consumption of the refrigerator 1000 decreases. All of the compressor 1001, the air blower 1003, and the blowout volume control devices may be controlled simultaneously, or may each be controlled individually.

In a specific control example, when the cold storage chamber 100 has a set temperature of 3° C. in the normal cooling operation mode, its set temperature in the cooling reduction control mode is set at 5° C. to increase the set temperature of the cold storage chamber 100. Next, the opening ratio of the cold storage chamber damper 102 is reduced to decrease the flow rate of cooling air. Or the rotation speed of the compressor 1001 may be decreased, or the air blow volume of the air blower 1003 may be decreased so as to decrease the cooling air flowing into the cold storage chamber 100. Decrease in cooling air flowing into the cold storage chamber 100 increases the inside temperature of the cold storage chamber 100. During the cooling reduction control mode, the cold storage chamber 100 is controlled to be stabilized at the set temperature of 5° C.

In the case of increasing the inside temperatures of a plurality of storage chambers, the rotation speed of the compressor 1001 is decreased, the air blow volume of the air blower 1003 is decreased, or the opening ratio of the blowout volume control devices is reduced in a similar manner to perform control of increasing the inside temperatures of the plurality of storage chambers.

Next, the control means 3 determines again whether or not the present moment corresponds to the regular outing time period or the sleeping time period (step S14). When the control means 3 determines that the present moment corresponds to the regular outing time period or the sleeping time period, the control means 3 continues the cooling reduction control mode (YES in step S14). On the contrary, when the control means 3 determines that the present moment corresponds to neither the regular outing time period nor the sleeping time period, i.e., when the regular outing time period or the sleeping time period is ended (NO in step S14), the control means 3 cancels the cooling reduction control mode and resumes the normal cooling operation mode (step S15). In step S15, the set temperature of the storage chamber is returned to the set temperature before starting control of the cooling reduction control mode.

As described in the foregoing, cooling reduction control which reduces cooling of the storage chambers is performed in the regular outing time period or the sleeping time period. As a consequence, cooling is reduced in the time periods when the frequency of opening and closing the door of the refrigerator 1000 is predicted to be zero or low, so that power consumption can be reduced. This makes it possible to obtain a high power-saving effect while maintaining the preservation quality of food and drink. Moreover, the users are saved from planning and setting a power-saving scheme. The users only need to input their own schedules, and power-saving operation can automatically be performed in accordance with the input schedule information. Thus, the trouble of the users planning and inputting the power-saving scheme can be eliminated, and a high power-saving effect can be obtained with simple inputting.

Figure 8:
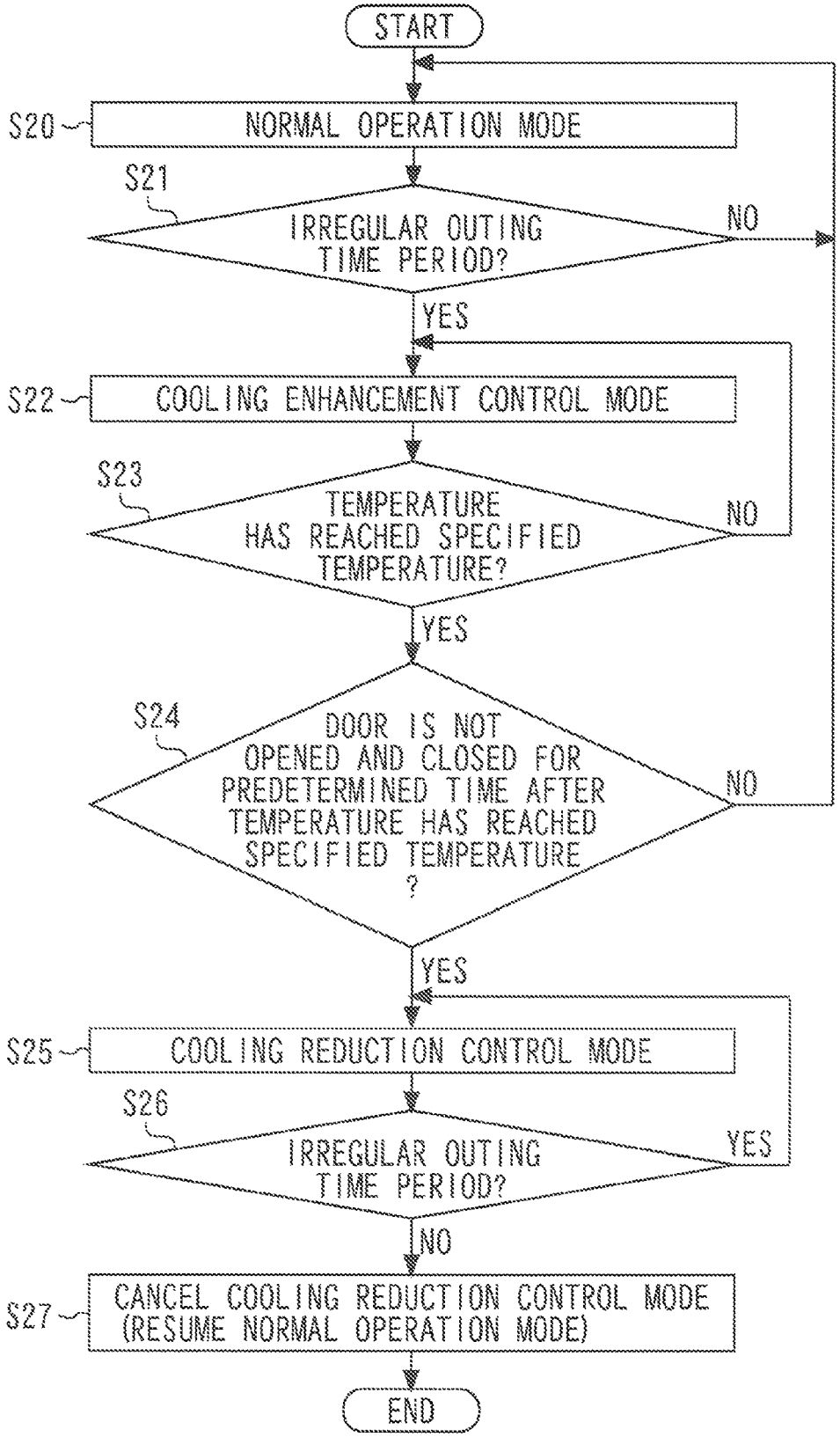
FIG. 8 is a flowchart illustrating control of the refrigerator in a first modification of the first embodiment of the present invention.

FIG. 8 is a flowchart illustrating control of the refrigerator 1000 in a first modification of the first embodiment of the present invention. The first modification of the first embodiment will be described with reference to the flowchart of FIG. 8.

In step S20, the refrigerator 1000, which is in a normal cooling operation mode, performs normal cooling operation. Next, based on the schedule information stored in the storage means 2, the control means 3 determines whether or not the present moment corresponds to the time period when the users are scheduled to go for an irregular outing (step S21). The time period when the users are scheduled to go for an irregular outing is hereinafter called "an irregular outing time period." In the first embodiment, when the present moment corresponds to the time period wherein the irregular outing time periods of all the users overlap, the control means 3 determines that the present moment corresponds to the irregular outing time period. However, in the present invention, when the present moment corresponds to the irregular outing time period(s) of a part of the users, the control means 3 may determine that the present moment corresponds to the irregular outing time period.

When the control means 3 determines that the present moment does not correspond to the irregular outing time period in a result of the determination, the control means 3 returns to the first step S20, and continues the normal cooling operation (NO in step S21).

On the contrary, when the control means 3 determines that the present moment corresponds to the irregular outing time period (YES in step S21), the processing proceeds to step S22. In step S22, the control means 3 sets a cooling enhancement control mode which enhances cooling of the storage chambers. The cooling enhancement control mode in this case performs control which is opposite to the aforementioned cooling reduction control mode. More specifically, in the cooling enhancement control mode, the set temperatures of the storage chambers are lowered, and the inside temperatures of the storage chambers are controlled to be lowered toward the lowered set temperatures. Specifically, the set temperatures of the storage chambers are lowered by 2° C. from the set temperatures in the normal cooling operation mode, for example. A width of lowering the set temperatures may be more than 2° C. or less than 2° C., as long as the width falls within the range of the set temperatures predetermined for each of the storage chambers.

The set temperatures of the storage chambers become low in the cooling enhancement control mode. The control means 3 determines whether or not the inside temperatures of the storage chambers have reached the lowered set temperatures (step S23).

When the inside temperatures of the storage chambers do not reach the lowered set temperatures in a result of the determination, the control means 3 continues the cooling enhancement control mode to enhance cooling of the storage chambers so that the inside temperatures of the storage chambers are approaching to the lowered set temperatures (NO in step S23).

On the contrary, when the inside temperatures of the storage chambers have reached the lowered set temperatures (YES in step S23), the processing proceeds to step S24. In step S24, the control means 3 determines, based on the door opening and closing information, whether or not the continuation time of the doors being in a closed state has reached predetermined time, the continuation time being computed from the time of the inside temperature of each storage chamber reaching a set temperature (step S24). Here, the predetermined time is, for example, 30 minutes, though it may be shorter or longer than 30 minutes. The predetermined period may arbitrarily be set by the users.

When the continuation time does not reach the predetermined time in a result of the determination, i.e., when any door has been opened before elapse of the predetermined time from the time of the inside temperature of each storage chamber reaching the set temperature, the control means 3 returns to the first normal cooling operation mode (step S20), and resumes normal operation (NO in step S24).

Meanwhile, when the continuation time has reached the predetermined time, i.e., when no door is opened and closed within the predetermined time from the time of the inside temperature of each storage chamber reaching the set temperature (YES in step S24), the control means 3 sets the cooling reduction control mode (step S25). In the cooling reduction control mode, the control means 3 increases the set temperatures of the storage chambers, and increases the inside temperatures toward the increased set temperatures. The cooling reduction control mode in this case is configured as a mode where a similar control as in the aforementioned cooling reduction control mode is performed. For example, the set temperatures are increased by 2° C. from the set temperatures in the normal operation.

Next, the control means 3 determines again whether or not the present moment corresponds to the irregular outing time period (step S26). When the control means 3 determines that the present moment is still in the irregular outing time period, the control means 3 continues the cooling reduction control mode to maintain the set temperatures of the storage chambers high for power-saving of the refrigerator 1000 (YES in step S26).

On the contrary, when the control means 3 determines that the present moment does not correspond to the irregular outing time period, i.e., when the irregular outing time period is ended (NO in step S26), the control means 3 cancels the cooling reduction control mode and resumes the normal cooling operation mode (step S27). More specifically, in step S27, the set temperatures of the storage chambers are returned to the set temperatures in the normal operation.

As described in the foregoing, in the first modification, cooling enhancement control is temporarily performed in the irregular outing time period. As a consequence, even when a user who is at home due to cancelled irregular outing schedule uses the refrigerator 1000, the temperature inside the storage chambers is lowered before the doors become frequently opened and closed, so that the preservation quality of food and drink inside the storage chambers can be maintained more reliably. A temperature difference provided by temperature reduction caused by the cooling enhancement control is smaller when cooling enhancement control is performed before the inside temperatures of the storage chambers increase than when cooling enhancement control is performed after the doors become frequently opened and closed and the inside temperatures of the storage chambers increase. Thus, the load of the refrigeration cycle including the compressor 1001 and the air blower 1003 is lessened, which results in reduction in power consumption of the refrigerator 1000, so that the power-saving effect can be obtained.

Figure 9:
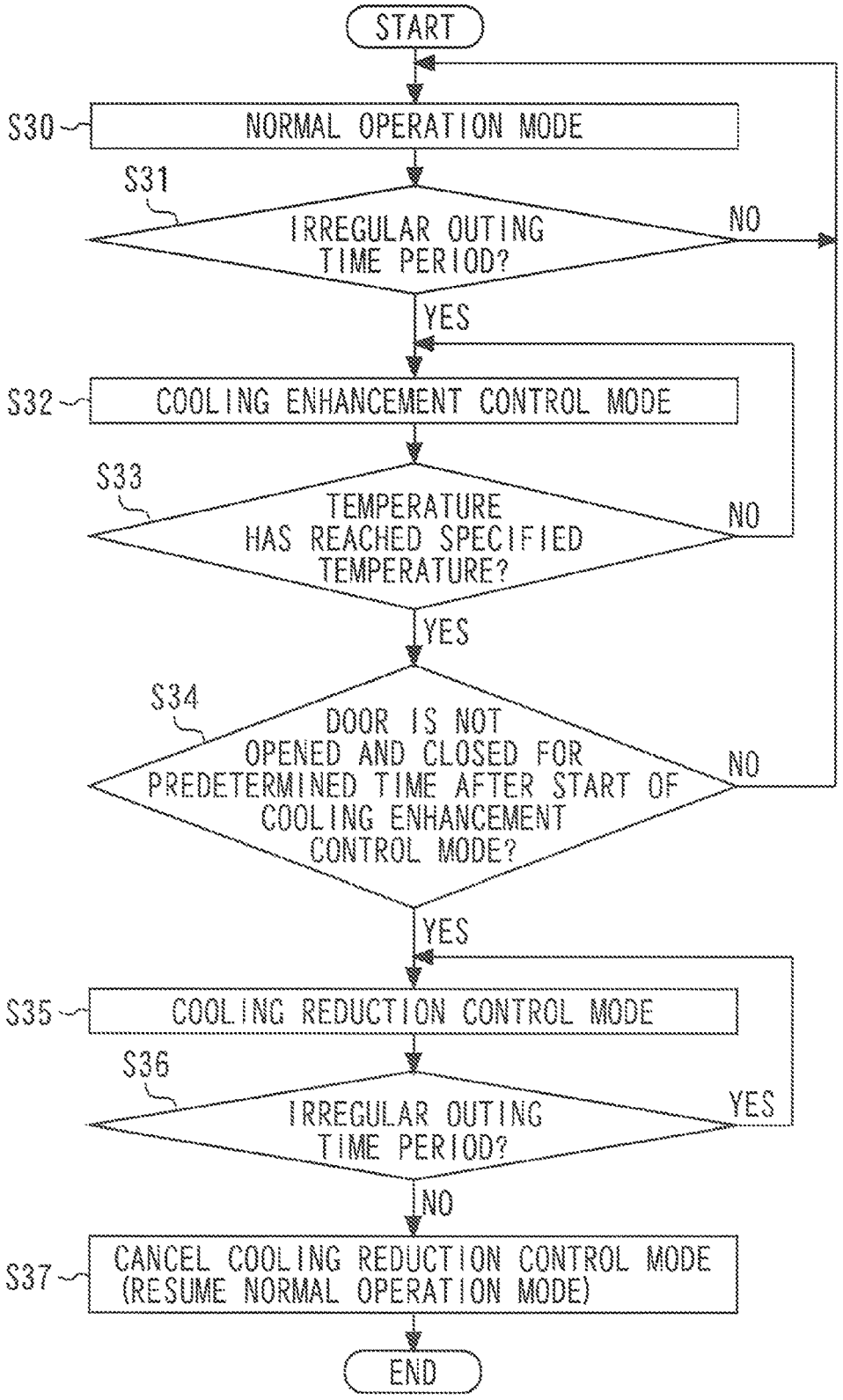
FIG. 9 is a flowchart illustrating control of the refrigerator in a second modification of the first embodiment of the present invention

FIG. 9 is a flowchart illustrating control of the refrigerator 1000 in a second modification of the first embodiment of the present invention. The second modification of the first embodiment will be described with reference to the flowchart of FIG. 9.

In step S30, the refrigerator 1000, which is in a normal cooling operation mode, performs normal cooling operation. Next, based on the schedule information stored in the storage means 2, the control means 3 determines whether or not the present moment corresponds to the irregular outing time period (step S31).

When the control means 3 determines that the present moment does not correspond to the irregular outing time period in a result of the determination, the control means 3 returns to the first step S30, and continues the normal cooling operation (NO in step S31).

On the contrary, when the control means 3 determines that the present moment corresponds to the irregular outing time period (YES in step S31), the processing proceeds to step S32. In step S32, the control means 3 sets the cooling enhancement control mode which enhances cooling of the storage chambers. The cooling enhancement control mode in this case performs control similar to the aforementioned cooling enhancement control mode. More specifically, in the cooling enhancement control mode, the set temperatures of the storage chambers are lowered, and the inside temperatures of the storage chambers are controlled to be lowered toward the lowered set temperatures. Specifically, the set temperatures of the storage chambers are lowered by 2° C. from the set temperatures in the normal cooling operation mode, for example. A width of lowering the set temperatures may be more than 2° C. or less than 2° C., as long as the width falls within the range of the set temperatures predetermined for each of the storage chambers.

The set temperatures of the storage chambers become low in the cooling enhancement control mode. The control means 3 determines whether or not the inside temperatures of the storage chambers have reached the lowered set temperatures (step S33).

When the inside temperatures of the storage chambers do not reach the lowered set temperatures in a result of the determination, the control means 3 continues the cooling enhancement control mode to enhance cooling of the storage chambers so that the inside temperatures of the storage chambers are approaching to the lowered set temperatures (NO in step S33).

Meanwhile, when the inside temperatures of the storage chambers have reached the lowered set temperatures (YES in step S33), the processing proceeds to step S34. In step S34, the control means 3 determines, based on the door opening and closing information, whether or not the continuation time of the doors being in a closed state has reached predetermined time, the continuation time being computed from the time of starting the cooling enhancement control mode (step S34). Here, the predetermined time is, for example, 30 minutes, though it may be shorter or longer than 30 minutes. The predetermined period may arbitrarily be set by the users.

When the continuation time does not reach the predetermined time in a result of the determination, i.e., when any door has opened before elapse of the predetermined time from the time of starting the cooling enhancement control mode, the control means 3 returns to the first normal cooling operation mode (step S30), and resumes normal operation (NO in step S34).

On the contrary, when the continuation time has reached the predetermined time, i.e., when no door has been opened and closed within predetermined time from the time of starting the cooling enhancement control mode (YES in step S34), the control means 3 sets the cooling reduction control mode (step S35). In the cooling reduction control mode, the control means 3 increases the set temperatures of the storage chambers, and increases the inside temperatures toward the increased set temperatures. The cooling reduction control mode in this case is configured as a mode where a similar control as in the aforementioned cooling reduction control mode is performed. For example, the set temperatures are increased by 2° C. from the set temperatures in the normal operation.

Next, the control means 3 determines again whether or not the present moment corresponds to the irregular outing time period (step S36). When the control means 3 determines that the present moment is still in the irregular outing time period, the control means 3 continues the cooling reduction control mode to maintain the set temperatures of the storage chambers high for power-saving of the refrigerator 1000 (YES in step S36).

On the contrary, when the control means 3 determines that the present moment does not correspond to the irregular outing time period, i.e., when the irregular outing time period is ended (NO in step S36), the control means 3 cancels the cooling reduction control mode and resumes the normal cooling operation mode (step S37). More specifically, in step S37, the set temperatures of the storage chambers are returned to the set temperatures in the normal operation.

According to the second modification, a similar effect as the first modification is obtained. In the second modification, the time of reckoning the continuation time is at the start of the cooling enhancement control mode. As a consequence, the time until starting the cooling reduction control mode is reduced from that in the first modification, and the time under the cooling reduction control is prolonged. Thus, the power-saving effect is enhanced more than that in the first modification.

The displaying means 10 of the operation panel 1 illustrated in FIGS. 1 and 2 can display not only the input schedule information on the users, but also current inside temperature information on each of the storage chambers, current set temperature information, and load information that is operation information on the refrigeration cycle device. Furthermore, the displaying means 10 of the operation panel 1 can also display details of control (for example, a running rate of the compressor 1001) changed based on the schedule information on the users and the like. The displaying means 10 of the operation panel 1 can also display power-saving information (for example, a reduced power consumption amount) under the cooling reduction control that is the control changed based on the schedule information on the users, i.e., in the power-saving operation.

Since the schedule information on the users and the details of control corresponding to the schedule information are displayed on the displaying means 10, it becomes possible to obtain not only an effect of enabling the users to confirm the details of automatic control but also an effect of being able to enlighten the users about how to use parameters such as the set temperatures which contribute to optimum cooling operation and power-saving operation.

In the first embodiment, the users only need to input the schedule information, and the optimum power-saving operation of the refrigerator 1000 can be controlled based on the input schedule information. Since the power-saving operation is based on the schedule information on the users, the power-saving operation is automatically performed not only in the determined time such as a time band of the power consumption peak, but also in the time when power can be saved as a result of reflecting the schedule information on the users. This makes it possible to obtain a higher power-saving effect. Moreover, it becomes possible to eliminate complicated work of the users devising and setting a power-saving plan for the power-saving operation. This enables the users to obtain a higher power-saving effect for the refrigerator 1000 by easy work.

Second Embodiment

Figure 10:
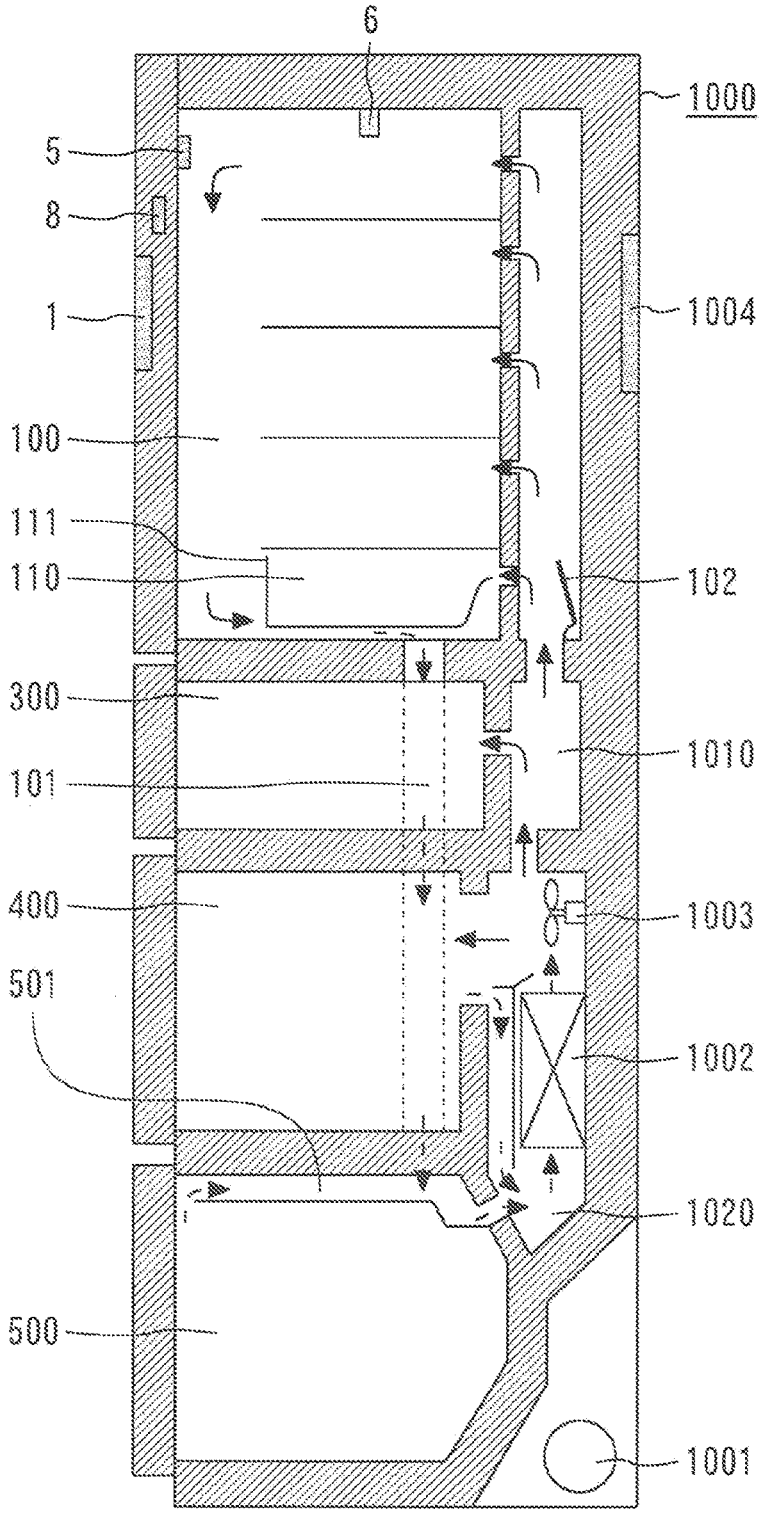
FIG. 10 is a sectional side view of a refrigerator of a second embodiment of the present invention.

FIG. 10 is a sectional side view of a refrigerator of a second embodiment of the present invention. It is to be noted that details not particularly mentioned in the second embodiment are identical to those in the first embodiment and that like functions and structure are designated by like reference signs.

A refrigerator 1000 of the second embodiment illustrated in FIG. 10 has a storage chamber temperature detector 5 used as a temperature detection means and a storage chamber pressure detector 6 for detecting the pressure inside a storage chamber, in addition to the configuration of the refrigerator 1000 of the first embodiment. The storage chamber temperature detector 5 is provided on the back surface of the door of the cold storage chamber 100. The storage chamber temperature detector 5 detects an upper door-side temperature in the cold storage chamber 100. The storage chamber pressure detector 6 is provided on a ceiling surface of the cold storage chamber 100. As described later, the storage chamber pressure detector 6 may function as a volume estimation means for estimating information about the volume of contents that are food and drink stored in the storage chamber (the cold storage chamber 100 in this case). The storage chamber temperature detector 5 and the storage chamber pressure detector 6 may be provided in another storage chamber other than the cold storage chamber 100, or may be provided in all the storage chambers.

Figure 11:
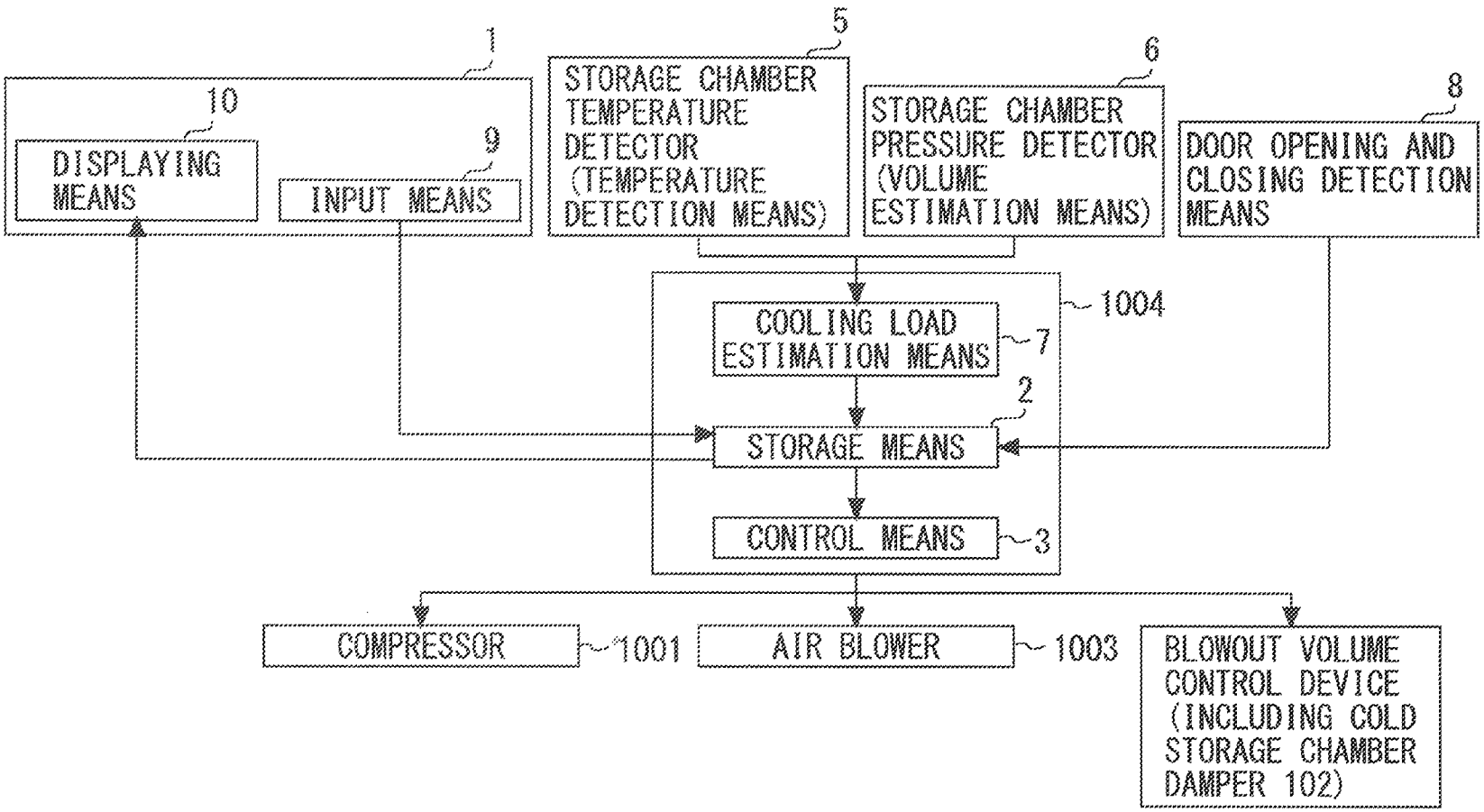
FIG. 11 is a functional block diagram of the refrigerator of the second embodiment of the present invention.

FIG. 11 is a functional block diagram of the refrigerator 1000 of the second embodiment of the present invention. As illustrated in FIG. 11, the controller 1004 includes a cooling load estimation means 7 for estimating a cooling load of the contents that are food and drink stored in the storage chamber (the cold storage chamber 100 in this case). The storage chamber temperature detector 5 and the storage chamber pressure detector 6 are connected to the cooling load estimation means 7. Based on the upper door-side temperature in the cold storage chamber 100 detected by the storage chamber temperature detector 5 and the pressure in the cold storage chamber 100 detected by the storage chamber pressure detector 6, the cooling load estimation means 7 estimates the cooling load of the contents that are food and drink stored in the cold storage chamber 100, and transmits the estimation result to the storage means 2. The storage means 2 stores the estimation result of the cooling load of the food and drink received from the cooling load estimation means 7, and transmits the result to the control means 3.

The cooling load estimation means 7 may estimate the cooling load based on the door opening and closing information detected by the door opening and closing detection means 8 in place of the temperature detected by the storage chamber temperature detector 5 and the pressure detected by the storage chamber pressure detector 6. The cooling load estimation means 7 may estimate the cooling load based on the door opening and closing information detected by the door opening and closing detection means 8 in addition to the temperature detected by the storage chamber temperature detector 5 and the pressure detected by the storage chamber pressure detector 6.

The control means 3 is configured to send, based on the schedule information on the users and the estimation result of the cooling load of the food and drink, a control signal which controls at least one of the compressor 1001, the air blower 1003, and the blowout volume control devices to at least one of the compressor 1001, the air blower 1003, and the blowout volume control devices.

Although the door opening and closing detection means 8 is configured to send the door opening and closing information to the storage means 2 as in the first embodiment, the door opening and closing detection means 8 may transmit the door opening and closing information to the cooling load estimation means 7 (illustration omitted). In that case, the cooling load estimation means 7 estimates the cooling load based on the door opening and closing information detected by the door opening and closing detection means 8. More specifically, the cooling load can be estimated to be larger as the doors are opened and closed more frequently, and the cooling load can be estimated to be smaller as the doors are opened and closed less frequently.

Now, a description is given of one example of operation with reference to FIG. 11. The description of the operation described in the first embodiment will be omitted.

When food and drink are kept in the refrigerator 1000, it is necessary to keep the storage chambers in a low temperature condition as much as possible to maintain the quality of the food and drink. When a large amount of food and drink are stored in the storage chambers, that is, when the cooling load of the food and drink is high, the food and drink are not easily cooled. In this case, increasing the set temperatures of the storage chambers becomes a direct cause of degrading the quality of the food and drink. Accordingly, when a large amount of food and drink are stored in the storage chambers, that is, when the cooling load of the food and drink is high, it is desirable to lower the set temperatures of the storage chambers. On the contrary, when a small amount of food and drink are stored in the storage chambers, that is, when the cooling load of the food and drink is low, the food and drink are easily cooled. Accordingly, the quality of food and drink is easily maintained even when the set temperatures are relatively high. Thus, it is desirable to change the set temperatures of the storage chambers by reflecting the storage amount of food and drink, i.e., the cooling load amount. In the second embodiment, therefore, the cooling load of the food and drink in the cold storage chamber 100, as a representative of the storage chambers, is estimated by the cooling load estimation means 7.

Figure 12:
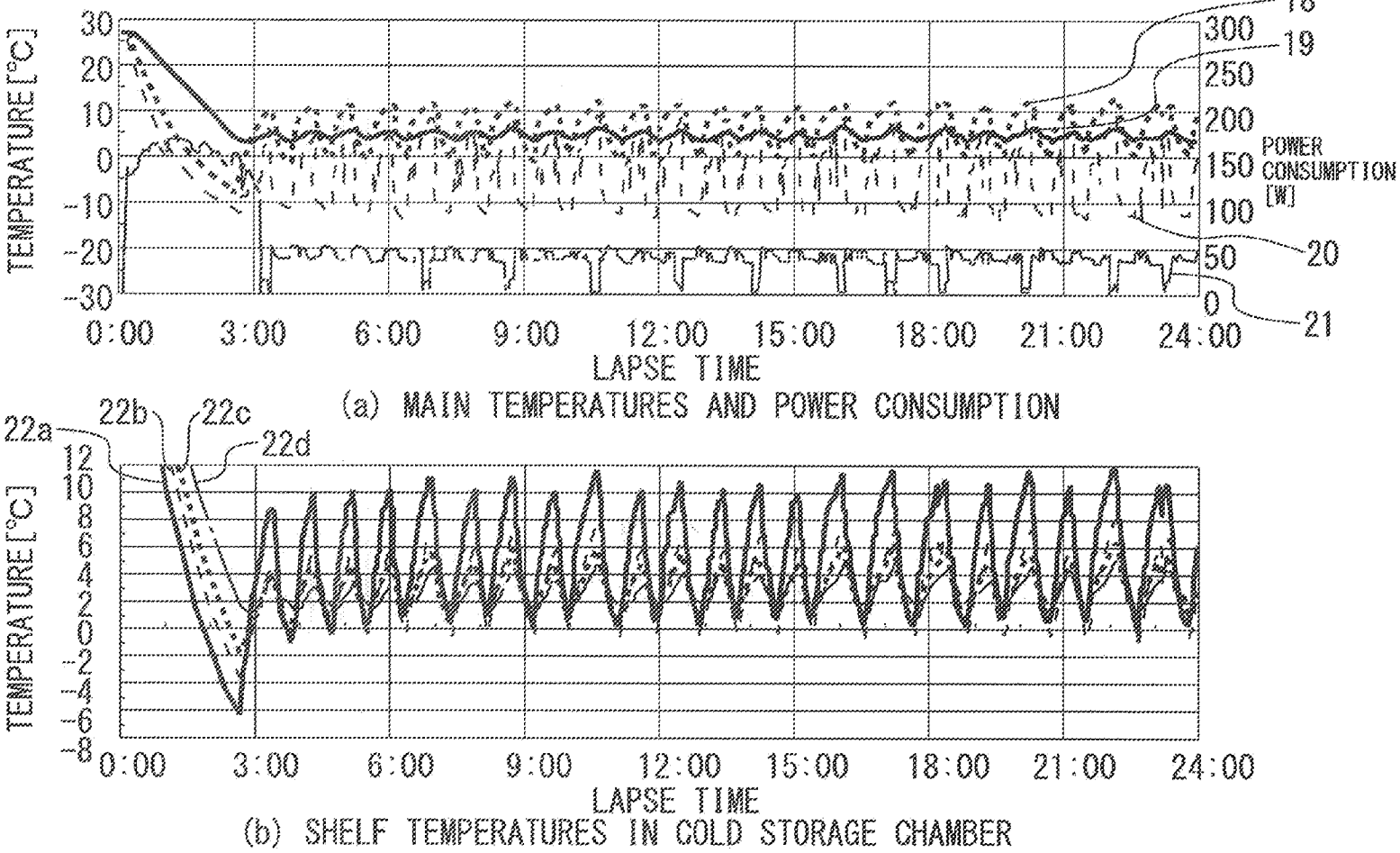
FIG. 12 illustrates one example of measured data indicating records of a temperature in a cold storage chamber and records of differential pressure between inside and outside of the cold storage chamber in the refrigerator of the second embodiment of the present invention.
Figure 13:
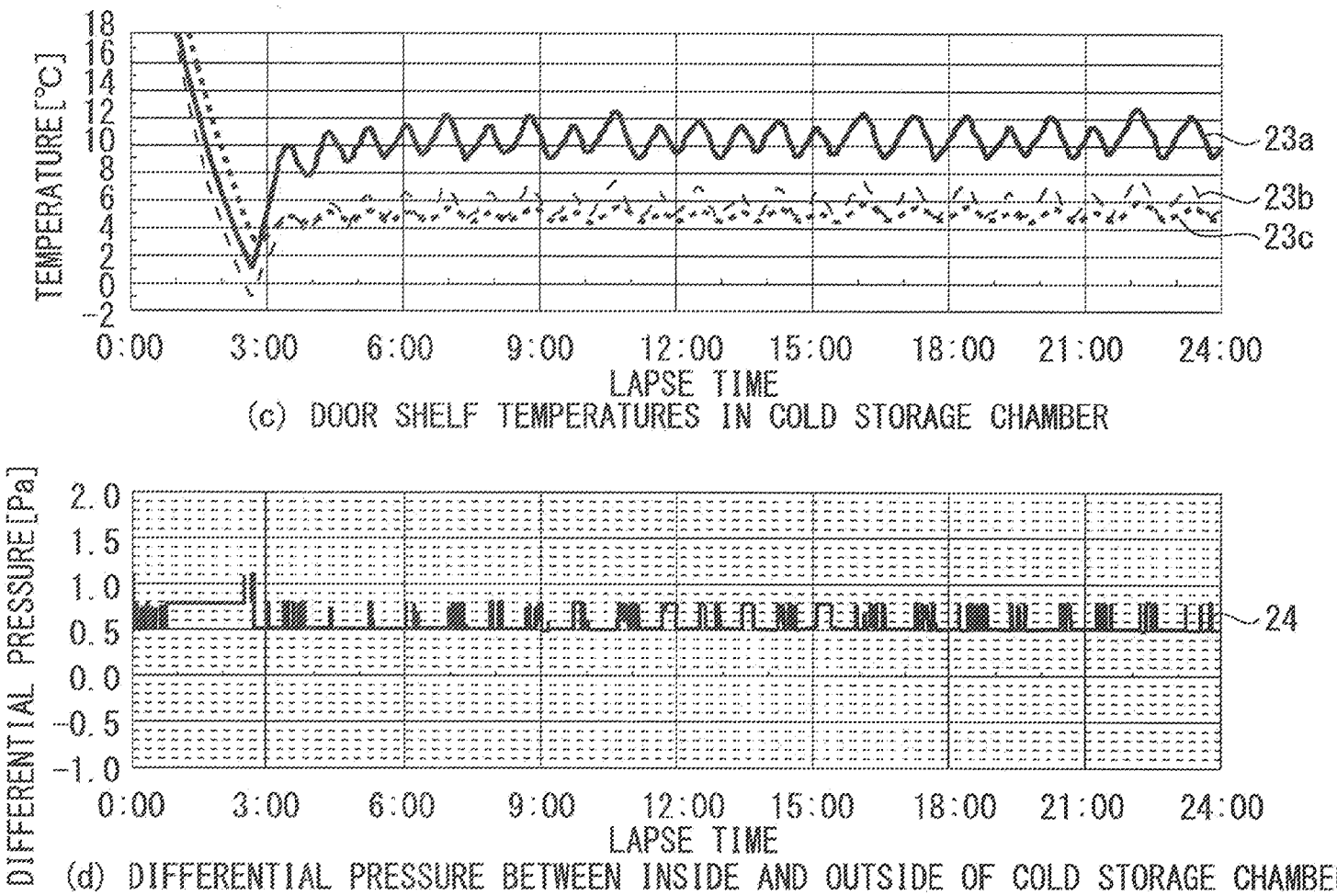
FIG. 13 illustrates one example of measured data indicating records of a temperature in a cold storage chamber and records of differential pressure between inside and outside of the cold storage chamber in the refrigerator of the second embodiment of the present invention.
Figure 14:
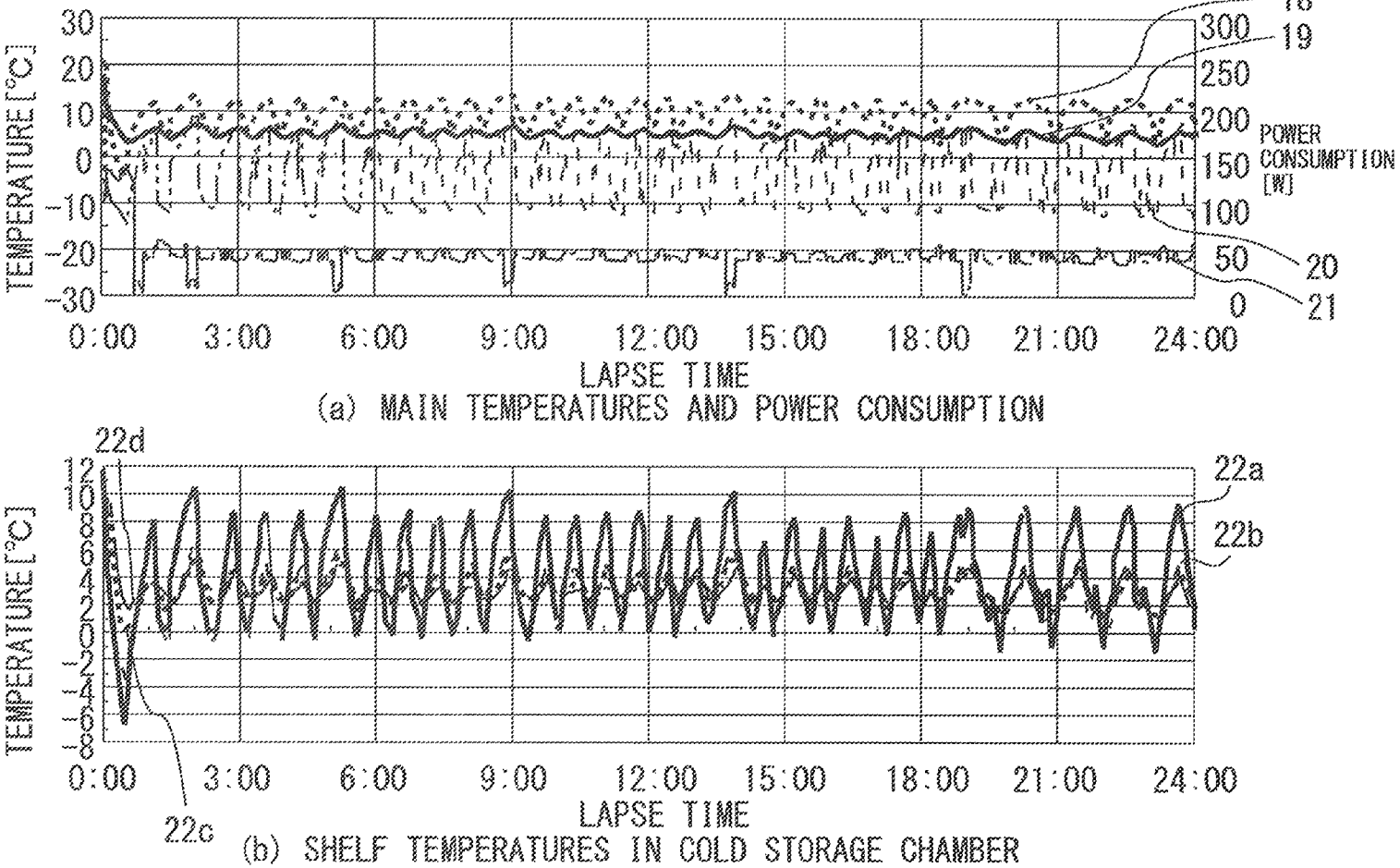
FIG. 14 illustrates one example of measured data indicating records of a temperature in a cold storage chamber and records of differential pressure between inside and outside of the cold storage chamber in the refrigerator of the second embodiment of the present invention.
Figure 15:
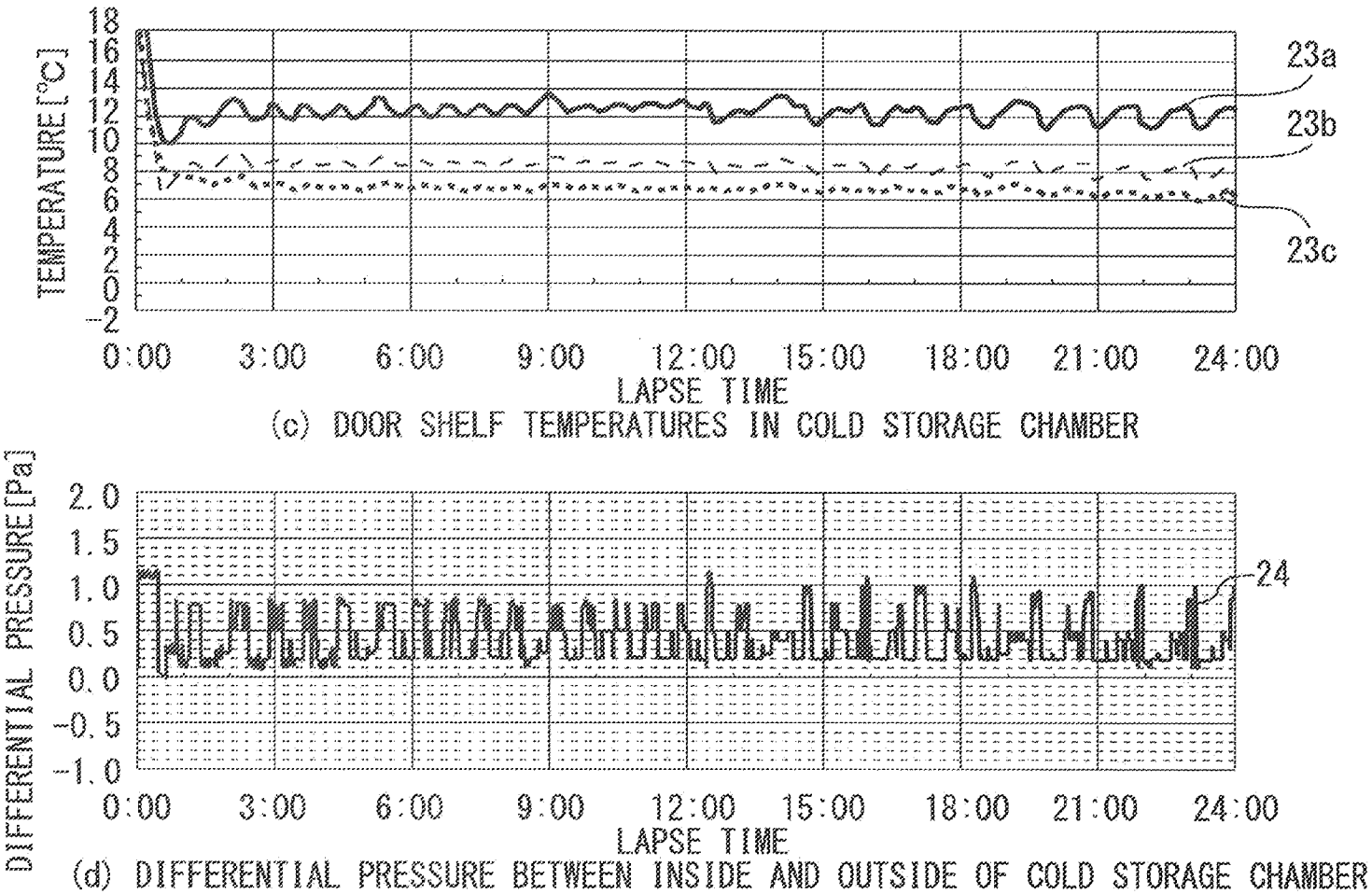
FIG. 15 illustrates one example of measured data indicating records of a temperature in a cold storage chamber and records of differential pressure between inside and outside of the cold storage chamber in the refrigerator of the second embodiment of the present invention.
Figure 16:
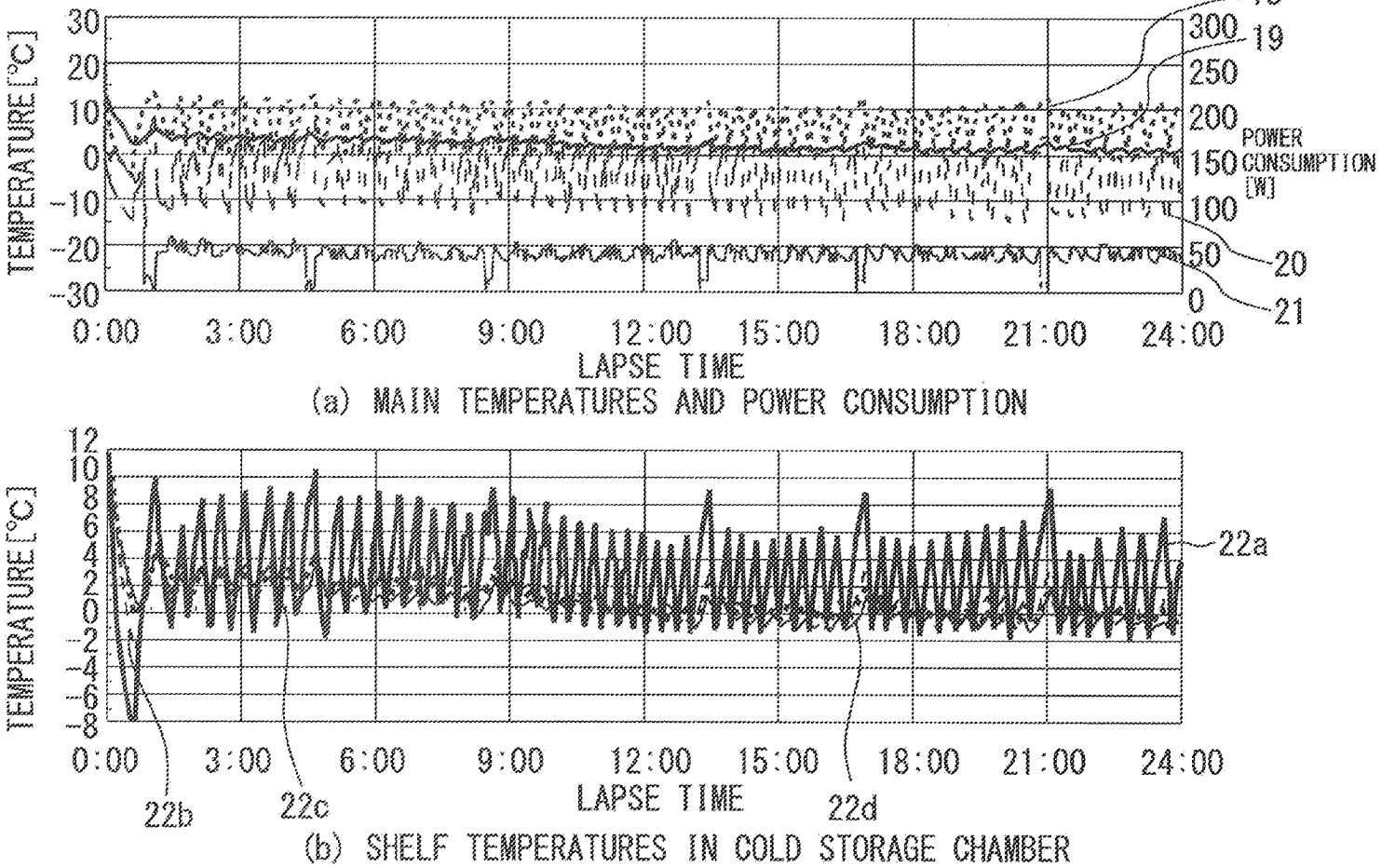
FIG. 16 illustrates one example of measured data indicating records of a temperature in a cold storage chamber and records of differential pressure between inside and outside of the cold storage chamber in the refrigerator of the second embodiment of the present invention.
Figure 17:
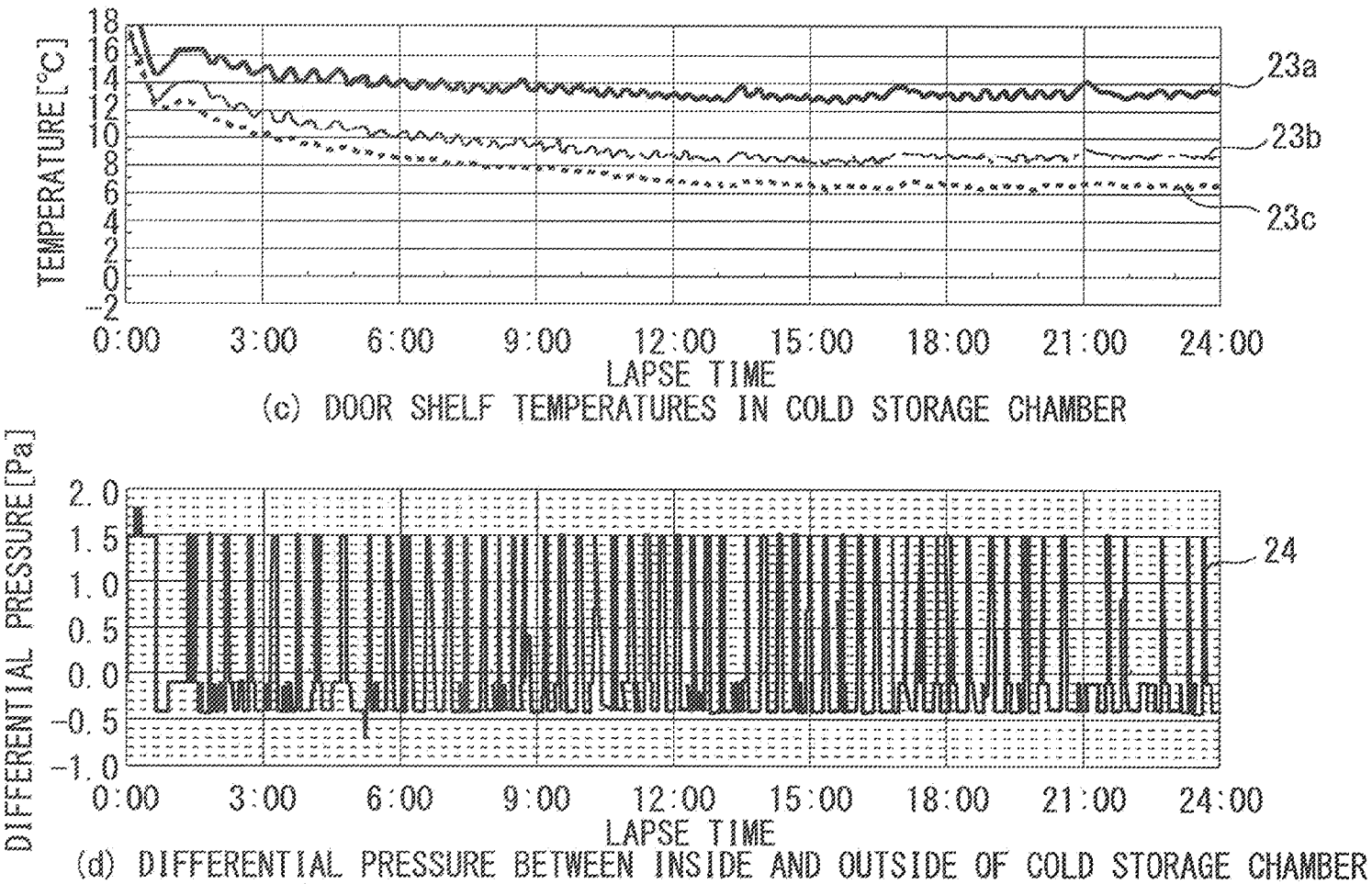
FIG. 17 illustrates one example of measured data indicating records of a temperature in a cold storage chamber and records of differential pressure between inside and outside of the cold storage chamber in the refrigerator of the second embodiment of the present invention.

FIGS. 12 to 17 illustrate one example of measured data. The measured data indicates records of the temperature in the cold storage chamber 100 and records of differential pressure between inside and outside of the cold storage chamber 100 in the refrigerator 1000 of the second embodiment of the present invention. The differential pressure between inside and outside of the cold storage chamber 100 is a difference between the pressure inside the cold storage chamber 100 and the pressure outside the refrigerator 1000 or the atmospheric pressure. A ratio of the volume of the food and drink stored in a storage chamber to the capacity of the storage chamber is hereinafter referred to as "storage capacity occupancy." FIGS. 12 and 13 illustrate the case where the storage capacity occupancy is 0%, FIGS. 14 and 15 illustrate the case where the storage capacity occupancy is 40%, and FIGS. 16 and 17 illustrate the case where the storage capacity occupancy is 70%. In data measurement of FIGS. 12 to 17, first, the door of the cold storage chamber 100 was fully opened for 1 minute, and then the refrigerator is operated for 24 hours. In that state, temperature and power consumption at each position in the cold storage chamber 100, and pressure in the cold storage chamber 100 detected by the storage chamber pressure detector 6 were measured. A differential pressure between inside and outside of the cold storage chamber 100 was calculated based on a difference between an actual measurement of the pressure in the cold storage chamber 100 and the atmospheric pressure.

FIGS. 12(*a*), 14(*a*), and 16(*a*) illustrate main temperatures and power consumption in the cold storage chamber 100. FIGS. 12(*b*), 14(*b*), and 16(*b*) illustrate shelf temperatures in the cold storage chamber 100. FIGS. 13(*c*), 15(*c*), and 17(*c*) illustrate door shelf temperatures in the cold storage chamber 100, and FIGS. 13(*d*), 15(*d*), and 17(*d*) illustrate differential pressure between inside and outside of the cold storage chamber 100.

In FIGS. 12(*a*), 14(*a*) and 16(*a*), there are a mean temperature 18 of the ceiling surface of the cold storage chamber 100, a mean temperature 19 of the back surface of the cold storage chamber 100, a mean temperature 20 of cooling air supplied from an outlet provided on the back surface of the cold storage chamber 100, and power consumption 21 of the refrigerator 1000 as a whole.

In FIGS. 12(*b*), 14(*b*) and 16(*b*), there are mean temperatures 22*a* to 22*d* of shelves in the cold storage chamber 100, the shelves being formed by dividing the cold storage chamber 100 into four stages with shelf boards. More specifically, the mean temperatures includes a mean temperature 22*a* of the uppermost shelf of the cold storage chamber 100, a mean temperature 22*b* of the second uppermost shelf of the cold storage chamber 100, a mean temperature 22*c* of the third uppermost shelf of the cold storage chamber 100, and a mean temperature 22*d* of the lowermost shelf of the cold storage chamber 100.

In FIGS. 13(*c*), 15(*c*) and 17(*c*), there are mean temperatures 23*a* to 23*c* of three door shelves provided on the back surface of the door of the cold storage chamber 100. More specifically, the mean temperatures include a mean temperature 23*a* of the upper door shelf of the cold storage chamber 100, a mean temperature 23*b* of the middle door shelf of the cold storage chamber 100, and a mean temperature 23*c* of the lower door shelf of the cold storage chamber 100.

In FIGS. 13(*d*), 15(*d*) and 17(*d*), there is a differential pressure 24 between inside and outside of the cold storage chamber 100. At the time of data measurement, bagged instant noodles were used as a food stored in the cold storage chamber 100. In FIGS. 12(*b*), 14(*b*) and 16(*b*), the mean temperatures 22*a* to 22*d* of the shelves of the cold storage chamber 100 were measured at positions on the back surface side of the food.

As indicated by the data of FIGS. 12 to 17, as the storage capacity occupancy is higher, the mean temperatures 22*a* to 22*d* of the shelves of the cold storage chamber 100 on the back surface side of the food are lower, while the mean temperatures 23*a* to 23*c* of the door shelves of the cold storage chamber 100 positioned on the door side of the food are higher. This indicates that supply of cooling air to the door side is obstructed by the food.

In the cases illustrated in FIGS. 16 and 17 where the storage capacity occupancy is 70% in particular, the mean temperature 22*c* of the third shelf of the cold storage chamber 100, which is a shelf temperature in the lower part of the cold storage chamber 100, and the mean temperature 22*d* of the lowermost shelf of the cold storage chamber 100 are lowered to 0° C. or less. In contrast, the mean temperature 23*a* of the upper door shelf of the cold storage chamber 100, which is a door shelf temperature in the upper part of the cold storage chamber 100, is kept at 13° C. to 14° C. The temperature of 13° C. to 14° C., which is out of a cold storage temperature zone, constitutes a temperature environment which promotes deterioration of food and drink.

In all of the cases where the storage capacity occupancy is 0%, 40%, and 70%, a maximum value of the power consumption 21 is kept at about 50 W. However, as the storage capacity occupancy is higher, a period in which the compressor 1001 is stopped and only the air blower 1003 is operated is shorter. This indicates that electric power consumption increases as the storage capacity occupancy is higher.

As illustrated in FIGS. 13(*d*), 15(*d*) and 17(*d*), as the flow rate of the cooling air is increased or decreased by continuously-performed opening and closing of the cold storage chamber damper 102, the differential pressure 24 between inside and outside of the cold storage chamber 100 also varies. A width of variation of the differential pressure 24 between inside and outside of the cold storage chamber 100 is larger as the storage capacity occupancy is higher.

Specifically, in the case illustrated in FIG. 13 where the storage capacity occupancy is 0%, the differential pressure 24 between inside and outside of the cold storage chamber 100 varies generally in the range of 0.5 Pa to 0.8 Pa, with a width of variation Δ of 0.3 Pa. In the case illustrated in FIG. 15 where the storage capacity occupancy is 40%, the differential pressure 24 between inside and outside of the cold storage chamber 100 varies generally in the range of 0.1 Pa to 1.1 Pa, with a width of variation Δ of 1.0 Pa. In the case illustrated in FIG. 17 where the storage capacity occupancy is 70%, the differential pressure 24 between inside and outside of the cold storage chamber 100 varies generally in the range of −0.4 Pa to 1.5 Pa, with a width of variation Δ of 1.9 Pa. As is indicated by the drawings, as the storage capacity occupancy is higher, i.e., as a surplus capacity in the cold storage chamber 100 is smaller, the maximum value of the differential pressure 24 between inside and outside of the cold storage chamber 100 increases at the time of supplying the cooling air, while a minimum value of the differential pressure 24 between inside and outside of the cold storage chamber 100 decreases at the time of stopping the cooling air. Thus, the width of variation and the absolute value of the differential pressure 24 between inside and outside of the cold storage chamber 100 are correlated with the storage capacity occupancy. More specifically, the width of variation and the absolute value of the differential pressure 24 between inside and outside of the cold storage chamber 100 are correlated with the volume of food and drink stored in the cold storage chamber 100. Thus, it becomes possible to estimate the volume of the food and drink stored in the cold storage chamber 100 based on the width of variation or the absolute value of the differential pressure 24 between inside and outside of the cold storage chamber 100 detected by the storage chamber pressure detector 6. As the volume or the storage capacity occupancy of the food and drink in the cold storage chamber 100 estimated in this way is larger, the cooling load estimation means 7 estimates the cooling load of the food and drink to be higher.

As is indicated by the temperature in the cold storage chamber 100 and the mean temperature 23*a* of the upper door shelf of the cold storage chamber 100 in particular, difficulty of cooling can be estimated by measuring the temperature at positions where the temperature is largely varied by the storage capacity occupancy. Accordingly, the cooling load estimation means 7 estimates the cooling load of the food and drink to be higher as the upper door-side temperature detected by the storage chamber temperature detector 5 is higher.

When the cooling load of the cold storage chamber 100 estimated by the cooling load estimation means 7 is large, increasing the set temperature of the cold storage chamber 100 accelerates temperature increase of the food and drink in the cold storage chamber 100, which may damage preservation quality of the food and drink. Accordingly, when the cooling load of the cold storage chamber 100 estimated by the cooling load estimation means 7 is large, it is desirable to avoid execution of the control which reduces cooling of the cold storage chamber 100. Accordingly, in the second embodiment, when the cooling load of the cold storage chamber 100 estimated by the cooling load estimation means 7 is larger than a preset high load determination value and when an execution request for cooling reduction control based on the schedule information on the users is received from the storage means 2, the control means 3 performs control to reduce cooling of at least one of the storage chambers other than the cold storage chamber 100, including the ice making chamber 200, the switching chamber 300, the freezing chamber 400, and the vegetable chamber 500 which are storage chambers subjected to cooling reduction in place of the cold storage chamber 100. In this case, the storage chamber subjected to cooling reduction in place of the cold storage chamber 100 is called "the other storage chamber." More specifically, in the second embodiment, at least one of the storage chambers including the ice making chamber 200, the switching chamber 300, the freezing chamber 400, and the vegetable chamber 500 corresponds to the other storage chamber. The cooling amount of the other storage chamber can be changed by controlling one or more of the compressor 1001, the air blower 1003, and the blowout volume control devices. Accordingly, in the second embodiment, one or more of the compressor 1001, the air blower 1003, and the blowout volume control devices corresponds to an another storage chamber cooling amount variable means for making the cooling amount of the other storage chamber variable.

The control means 3 reduces cooling of the other storage chamber by increasing the set temperature of the other storage chamber. In the case of reducing cooling of the other storage chamber in place of the cold storage chamber 100, the control means 3 transmits a signal to decrease the rotation speed of the compressor 1001 and the air blow volume of the air blower 1003, and increases the set temperature of the other storage chamber. This makes it possible to reduce a power consumption level. By increasing the opening ratio of the cold storage chamber damper 102, the cold storage chamber 100 can preferentially be cooled, so that the preservation quality of the food and drink stored in the cold storage chamber 100 can be maintained. Detailed operation relating to control of the second embodiment will be described hereinbelow with reference to the flowchart illustrated in FIG. 18.

Figure 18:
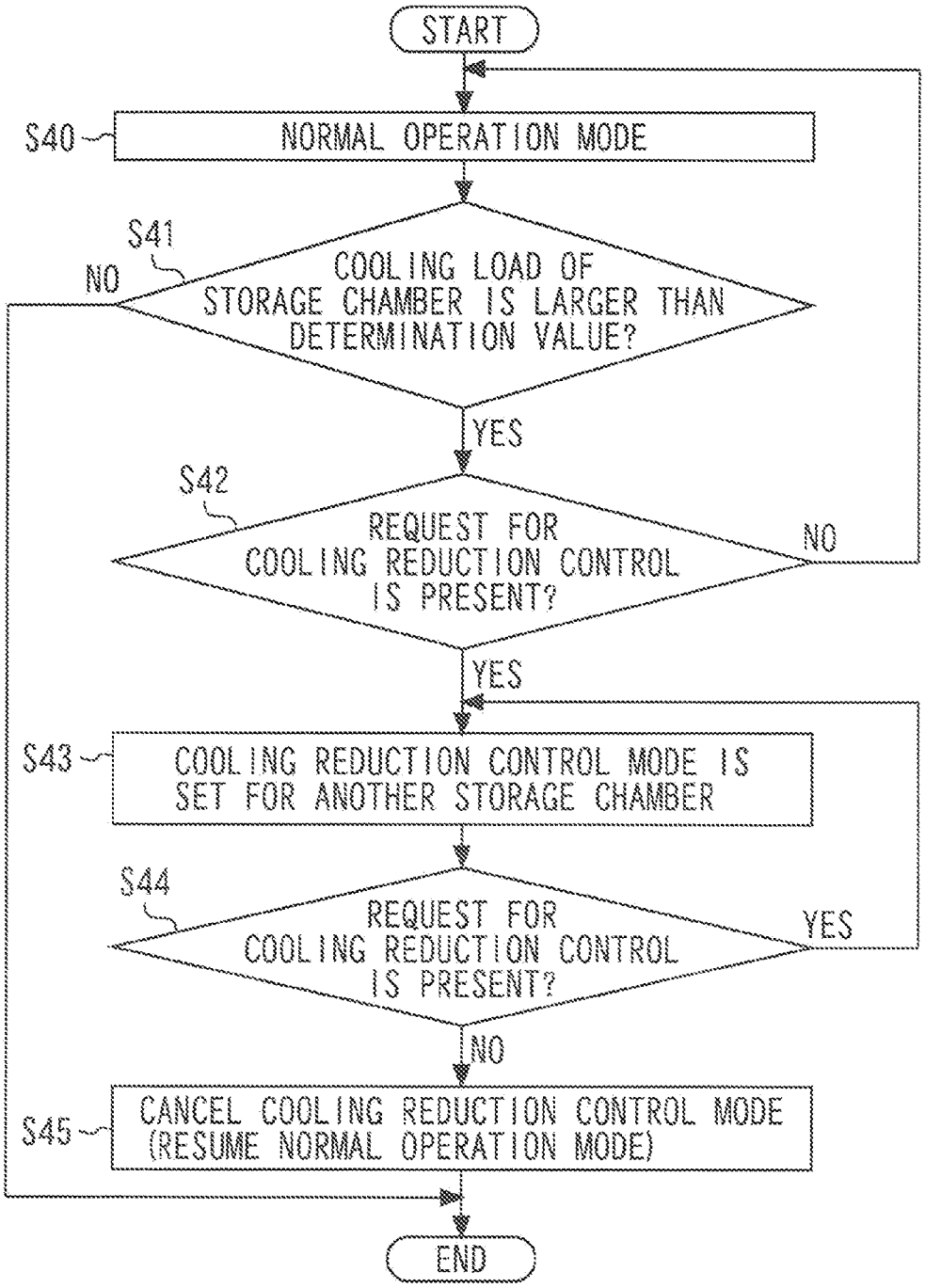
FIG. 18 is a flowchart illustrating control of the refrigerator of the second embodiment of the present invention.

FIG. 18 is a flowchart illustrating control of the refrigerator 1000 of the second embodiment of the present invention. In step S40, the control means 3, which is in a normal cooling operation mode, performs normal cooling operation for each of the storage chambers. During the normal cooling operation, the control means 3 determines whether or not the cooling load of the cold storage chamber 100 estimated by the cooling load estimation means 7 is larger than a preset high load determination value (step S41). In step S41, the control means 3 determines, for example, whether or not the inside of the cold storage chamber 100 is too overloaded to allow for an increase of the set temperature by 1° C. It should naturally be understood that the threshold of a margin of increase of the set temperature, which is set to 1° C. in this example, may be more than 1° C. or less than 1° C.

When the control means 3 determines that the cooling load of the cold storage chamber 100 estimated by the cooling load estimation means 7 is smaller than the high load determination value (NO in step S41), the control means 3 performs cooling reduction control which reduces cooling of the cold storage chamber 100 based on the schedule information on the users. The cooling reduction control for the cold storage chamber 100 based on the schedule information on the users in this case can be performed by, for example, the same method as described in FIGS. 7 to 9 of the first embodiment, and therefore a description thereof is omitted herein.

On the contrary, when the control means 3 determines that the cooling load of the cold storage chamber 100 estimated by the cooling load estimation means 7 is larger than the high load determination value (YES in step S41), the control means 3 proceeds to step S42. In step S42, the control means 3 determines the presence of an execution request for cooling reduction control, i.e., for power-saving operation, based on the schedule information on the users. In step S42, the control means 3 determines that the execution request for cooling reduction control is present if, for example, the present moment corresponds to the regular outing time period or the sleeping time period. If the present moment corresponds to neither the regular outing time period nor the sleeping time period, the control means 3 determines that the execution request for cooling reduction control is not present.

When the control means 3 determines that the execution request for cooling reduction control is not present, the control means 3 returns to the first step S40, and continues the normal cooling operation (NO in step S42).

On the contrary, when the control means 3 determines that the execution request for cooling reduction control is present (YES in step S42), the control means 3 sets the cooling reduction control mode which reduces cooling of the other storage chamber (step S43). The cooling reduction control mode which reduces cooling of the other storage chamber is configured to control at least one of the compressor 1001, the air blower 1003, and the blowout volume control device (another storage chamber cooling amount variable means) so as to increase the set temperature of the other storage chamber, and to perform control to increase the inside temperature of the other storage chamber toward the increased set temperature.

Although not illustrated in FIG. 18, it may be determined whether or not the doors of the refrigerator 1000 have been opened and closed within the past predetermined time before setting the cooling reduction control mode which reduces cooling of the other storage chamber when the result of step S42 is YES. The predetermined time in this case may be 30 minutes, for example. If the doors are not opened and closed for 30 minutes, the processing proceeds to step S43 and the cooling reduction control mode which reduces cooling of the other storage chamber is set. The time to determine opening and closing of the doors may be shorter or longer than 30 minutes. The time may arbitrarily be set by the users.

Although not illustrated in FIG. 18, the cooling load of the other storage chamber may be estimated before setting the cooling reduction control mode which reduces cooling of the other storage chamber when the result of step S42 is YES. When the cooling load of the other storage chamber is higher than a specified value, the cooling load of still another storage chamber, which is other than the cold storage chamber 100 and the other storage chamber, is determined. Thus, the cooling load of each of the storage chambers of the refrigerator 1000 is sequentially estimated, and the cooling reduction control mode which reduces cooling of a storage chamber, whose estimated cooling load is smaller than the specified value, may be set. As a result, the cooling load can be determined in each of the storage chambers, which makes it possible to execute power-saving operation while more reliably maintaining the preservation quality of the food and drink in the storage chambers.

After step S43, the control means 3 determines again the presence of an execution request for cooling reduction control based on the schedule information on the users (step S44). In step S44, the control means 3 determines that the execution request for cooling reduction control is present, when, for example, the present moment corresponds to the regular outing time period or the sleeping time period. When the present moment corresponds to neither the regular outing time period nor the sleeping time period, the control means 3 determines that the execution request for cooling reduction control is not present.

When the control means 3 determines that the execution request for cooling reduction control is present, the control means 3 continues the cooling reduction control mode which reduces cooling of the other storage chamber (YES in step S44). On the contrary, when the control means 3 determines that the execution request for cooling reduction control is not present (NO in step S44), the control means 3 cancels the cooling reduction control mode which reduces cooling of the other storage chamber, and resumes the normal cooling operation mode (step S45). In step S45, the set temperature of each of the storage chambers is returned to the temperature before starting the cooling reduction control mode.

As described before, even when the cooling load of a specific storage chamber (cold storage chamber 100) is too high to apply the cooling reduction control, i.e., the power-saving operation, to the specific storage chamber, the cooling reduction control can be applied to another storage chamber which is different from the specific storage chamber. As a result, power-saving operation can be executed even with a high cooling load, so that the power-saving effect is obtained.

Figure 19:
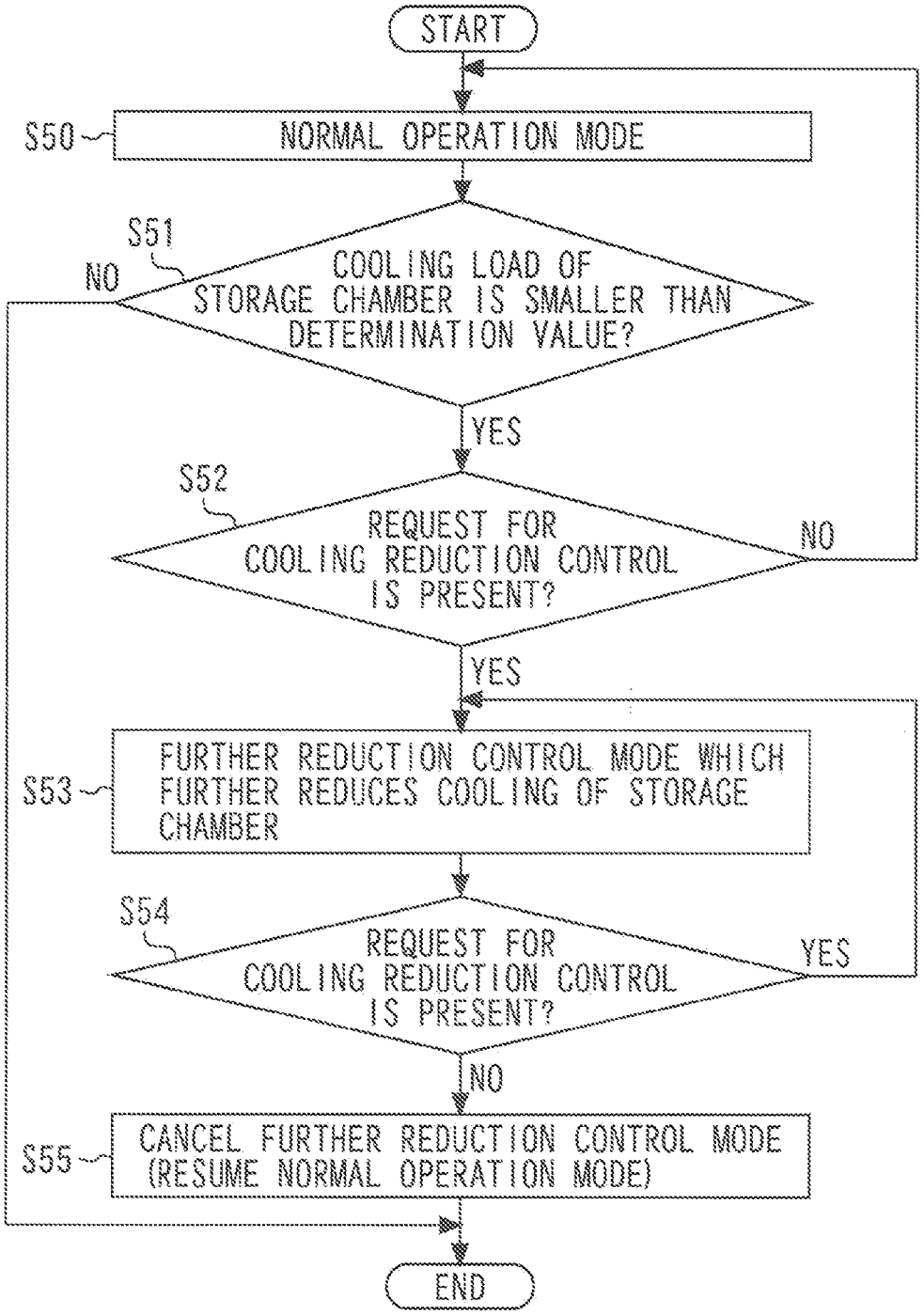
FIG. 19 is a flowchart illustrating control of the refrigerator in a modification of the second embodiment of the present invention.

FIG. 19 is a flowchart illustrating control of the refrigerator 1000 in a modification of the second embodiment of the present invention. The modification of the second embodiment will be described hereinbelow in detail with reference to the flowchart illustrated in FIG. 19.

When the cooling load of the cold storage chamber 100 estimated by the cooling load estimation means 7 is small and when, for example, a small amount of food and drink are stored in the cold storage chamber 100 and a heat capacity of the food and drink is low, the temperature of the food and drink in the cold storage chamber 100 does not easily increase even if the set temperature of the cold storage chamber 100 is increased, and therefore the preservation quality of the food and drink is less likely to be spoiled. Accordingly, in the modification of the second embodiment, when the cooling load of the cold storage chamber 100 estimated by the cooling load estimation means 7 is smaller than a preset low load determination value at the time of executing the cooling reduction control which reduces cooling of the cold storage chamber 100 based on the schedule information on the users, the control means 3 performs further reduction control which reduces cooling of the cold storage chamber 100 more than the case where the cooling load is larger than the low load determination value. For example, the control means 3 further increases a margin of increase of the set temperature of the cold storage chamber 100 in the further reduction control for the cold storage chamber 100 as compared with the ordinary cooling reduction control for the cold storage chamber 100. This makes it possible to obtain a considerable power-saving effect.

In step S50 of FIG. 19, the control means 3, which is in a normal cooling operation mode, performs normal cooling operation for each of the storage chambers. During the normal cooling operation, the control means 3 determines whether or not the cooling load of the cold storage chamber 100 estimated by the cooling load estimation means 7 is smaller than a preset low load determination value (step S51).

When the control means 3 determines that the cooling load of the cold storage chamber 100 estimated by the cooling load estimation means 7 is larger than the low load determination value (NO in step S51), the control means 3 performs cooling reduction control which reduces cooling of the cold storage chamber 100 based on the schedule information on the users. Since the cooling reduction control for the cold storage chamber 100 based on the schedule information on the users in this case can be performed by, for example, the same method as described in FIGS. 7 to 9 of the first embodiment, a description thereof is omitted herein. The cooling reduction control for the cold storage chamber 100 in the case of NO in step S51 is hereinbelow called "ordinary cooling reduction control."

On the contrary, when the control means 3 determines that the cooling load of the cold storage chamber 100 estimated by the cooling load estimation means 7 is smaller than the low load determination value (YES in step S51), the control means 3 proceeds to step S52. In step S52, the control means 3 determines the presence of an execution request for cooling reduction control, i.e., power-saving operation, based on the schedule information on the users. In step S52, the control means 3 determines that the execution request for cooling reduction control which reduces cooling of the cold storage chamber 100 is present, when, for example, the present moment corresponds to the regular outing time period or the sleeping time period. When the present moment corresponds to neither the regular outing time period nor the sleeping time period, the control means 3 determines that the execution request for the cooling reduction control which reduces cooling of the cold storage chamber 100 is not present.

When the control means 3 determines that the execution request for cooling reduction control is not present, the control means 3 returns to the first step S50, and continues the normal cooling operation (NO in step S52).

On the contrary, when the control means 3 determines that the execution request for cooling reduction control is present (YES in step S52), the control means 3 sets the further reduction control mode which reduces cooling of the cold storage chamber 100 more than the cooling reduction control for the cold storage chamber 100 performed in the case of NO in step S51 (step S53). In the further reduction control mode, the control means 3 controls at least one of the compressor 1001, the air blower 1003, and the cold storage chamber damper 102 to reduce cooling of the cold storage chamber 100 less than the ordinary cooling reduction control. For example, when the set temperature of the cold storage chamber 100 is set to be increased by 2° C. in the ordinary cooling reduction control, the set temperature of the cold storage chamber 100 is increased by 3° C. in the further reduction control. More specifically, in the further reduction control, the set temperature is higher by 1° C. than the set temperature in the ordinary cooling reduction control. The margin of increase of the set temperature may be any value as long as the margin is within the preset temperature range. The margin of increase of the set temperature under the further reduction control as compared with the set temperature under the ordinary cooling reduction control may be more than 1° C. or less than 1° C.

Although not illustrated in FIG. 19, when the result of step S52 is YES, it may be determined whether or not the doors of the refrigerator 1000 have been opened and closed within the past predetermined time before setting the further reduction control mode. The predetermined time in this case may be 30 minutes, for example. If the doors are not opened and closed for 30 minutes, the processing proceeds to step S53 and the further reduction control mode is set. The time to determine opening and closing of the doors may be shorter or longer than 30 minutes. The time may arbitrarily be set by the users.

After step S53, the control means 3 determines again the presence of an execution request for cooling reduction control based on the schedule information on the users (step S54). In step S54, the control means 3 determines that the execution request for cooling reduction control is present, when, for example, the present moment corresponds to the regular outing time period or the sleeping time period. When the present moment corresponds to neither the regular outing time period nor the sleeping time period, the control means 3 determines that the execution request for cooling reduction control is not present.

When the control means 3 determines that the execution request for cooling reduction control is present, the control means 3 continues the further reduction control mode (YES in step S54). On the contrary, when the control means 3 determines that the execution request for cooling reduction control is not present (NO in step S54), the control means 3 cancels the farther reduction control mode, and resumes the normal cooling operation mode (step S55). In step S55, the set temperature of the cold storage chamber 100 is returned to the temperature before starting the further reduction control mode.

As described before, when the execution request for the cooling reduction control based on the schedule information on the users is present and the cooling load of the storage chamber (cold storage chamber 100) is low, a higher power-saving effect can be obtained by setting the further reduction control mode which reduces cooling of the storage chamber (cold storage chamber 100) less than the case of the ordinary cooling reduction control mode.

In another example of the second embodiment, assume a case where, for example, it is determined by the cooling load estimation means 7 that the cooling load of the cold storage chamber 100 is large when a command for lowering the set temperature, that is, a rapid cooling command is received from the storage means 2. In this case, the opening ratio of the cold storage chamber damper 102 is set higher to preferentially cool the cold storage chamber 100, and then a signal to increase the rotation speed of the compressor 1001 and the air blow volume of the air blower 1003 is transmitted. As a result, it becomes possible to minimize the increase in power consumption level.

On the contrary, when it is determined by the cooling load estimation means 7 that the cooling load is small, that is, for example, when the low temperature state is maintained even though the storage capacity occupancy in the storage chambers is high, it becomes possible to form a targeted low temperature environment, without increasing the rotation speed of the compressor 1001 and the air blow volume of the air blower 1003 up to values commanded by the storage means 2, i.e., without performing excessive cooling operation.

In FIGS. 10 and 11, the storage chamber temperature detector 5 and the storage chamber pressure detector 6 are provided in the storage chamber, and the cooling load estimation means 7 determines the cooling load of the food and drink in the storage chamber in based on the upper door-side temperature and the pressure in the storage chamber. However, as illustrated in FIGS. 12 to 17, the cooling load of the food and drink in the storage chamber can be estimated even with one of the upper door-side temperature and the pressure in the storage chamber. Accordingly, the refrigerator 1000 can spare one of the storage chamber temperature detector 5 and the storage chamber pressure detector 6. When one of the storage chamber temperature detector 5 and the storage chamber pressure detector 6 is omitted, the cooling load of food and drink can still be reflected upon the control means 3, and therefore, the aforementioned effect can be obtained by reflecting the cooling load at low cost.

In FIGS. 10 and 11, when the cooling load estimation means 7 determines the cooling load of the food and drink in the storage chamber, it is desirable to reflect the door opening and closing record which causes a temporary increase in temperatures of the storage chamber. The refrigerator 1000 is generally equipped with the door opening and closing detection means 8, such as a magnet-type open and close switch, for detecting opening and closing of the doors. Since the pressure in the storage chambers changes with opening and closing of the doors, opening and closing of the doors is also detectable by the storage chamber pressure detector 6. Accordingly, door opening and closing record data can be obtained without adding a dedicated detection apparatus. Thus, it becomes possible to determine the cooling load of food and drink with more sufficient accuracy in consideration of the influence of temporary temperature increase or pressure decrease caused by opening and closing of the doors.

In FIGS. 10 and 11, the control means 3 is configured to send a control signal to the compressor 1001, the air blower 1003, and the cold storage chamber damper 102 based on the schedule information on the users, which is input with the operation panel 1 and managed in the storage means 2, and also based on the cooling load of the food and drink received from the cooling load estimation means 7. The schedule information on the users, such as information on whether the users are at home or out and absent, life patterns of the users, and a purchasing pattern of the user household (food and drink purchase schedule information), are reflected upon opening and closing of the doors of the refrigerator 1000, the amount of food and drink stored in the storage chambers, and the inside temperatures of the storage chambers. Accordingly, the control means 3 can estimate the schedules of the users based on at least one of the record of the information about opening and closing of the doors of the refrigerator 1000, the record of the information (for example, storage capacity occupancy) about the volume of the food and drink stored in the storage chambers, and the record of the information about the inside temperatures of the storage chambers.

For example, the doors are not opened and closed when no user is present. The double-income households show the tendency of the volume of the food and drink stored in the storage chamber increasing in the weekend when most of the purchases are made. Accordingly, it becomes possible to estimate the schedules of the users based on at least one of the temperatures detected by the storage chamber temperature detector 5, the storage capacity occupancy detected by the storage chamber pressure detector 6, and the door opening and closing information detected by the storage chamber pressure detector 6 or the door opening and closing detection means 8, without inputting the schedules with the operation panel 1. The control means 3 may also update or correct the schedule information on the users stored in the storage means 2 by reflecting at least one of the record of the information about opening and closing of the doors of the refrigerator 1000, the record of the information (for example, storage capacity occupancy) about the volume of the food and drink stored in the storage chambers, and the record of the information about the inside temperatures of the storage chambers. For example, when the control means 3 detects that the frequency of opening and closing the doors of the refrigerator 1000, the volume of the food and drink stored in the storage chambers (storage capacity occupancy), or the inside temperatures of the storage chambers tend to increase in the weekend, the control means 3 can update or correct the information on the purchasing pattern stored in the storage means 2 to be a pattern of making a bulk purchase in the weekend.

As in the first embodiment, the displaying means 10 of the operation panel 1 can display not only the input schedules of the users and the details of control changed based on a command of the storage means 2, but also the information on the cooling load in the storage chambers estimated by the cooling load estimation means 7. By displaying the schedules of the users, the details of control corresponding thereto, and the cooling load condition at the time thereof, not only the users can confirm the details of automatic control, but also the correlation between the cooling load and power consumption can be exhibited to the users. This makes it possible to provide the effect of being able to educate power-saving actions with respect to storing methods.

In the second embodiment, both or one of the input means 9 and the displaying means 10 of the operation panel 1 may be provided separately from the main body of the refrigerator 1000. In that case, both or one of the input means 9 and the displaying means 10 of the operation panel 1 may be configured to be attachable to or detachable from the main body of the refrigerator 1000. Or both or one of the input means 9 and the displaying means 10 of the operation panel 1 may be configured to be unmountable on the main body of the refrigerator 1000. When both or one of the input means 9 and the displaying means 10 of the operation panel 1 is provided separately from the main body of the refrigerator 1000, both or one of the input means 9 and the displaying means 10 of the operation panel 1 communicate with the controller 1004 in a wired or wireless manner. In this case, the users can not only confirm the operation information and abnormal condition of the refrigerator 1000 from a long distance, but also can confirm, for example, the overloaded condition of the refrigerator 1000 in the middle of shopping. This makes it possible to provide an effect of enhancing convenience, such as suppressing purchases which cannot be kept in the refrigerator 1000.

Although the configuration of providing the storage chamber temperature detector 5 and the storage chamber pressure detector 6 provided in the cold storage chamber 100 has been described in the second embodiment, these detectors may be provided in any storage chamber and the detectors may be provided in a plurality of storage chambers. No matter at which storage chamber the cooling load is determined, similar effect can be obtained. If the cooling loads of all the storage chambers can be reflected in particular, cooling operation control with higher precision can be executed and the cooling load of each of the storage chambers can individually be detected. This makes it possible to provide an effect of being able to estimate the life patterns or purchasing patterns of the users in more details based on the records indicating, for example, that the door of the freezing chamber 400 is not at all opened and closed and the cooling load of the freezing chamber 400 shows almost no change, but the cooling load of the vegetable chamber 500 undergoes a lot of changes.

As described in the foregoing, since the cooling load estimation means for estimating the cooling load in the storage chambers is provided in the second embodiment, it becomes possible to control power-saving operation of the storage chambers in consideration of both of the schedule information on the users and the cooling load. Thus, a high power-saving effect can be obtained while the preservation quality of the food and drink in the storage chamber can be maintained. It is obvious that the effect demonstrated in the first embodiment is also demonstrated in the second embodiment.

Third Embodiment

Figure 20:
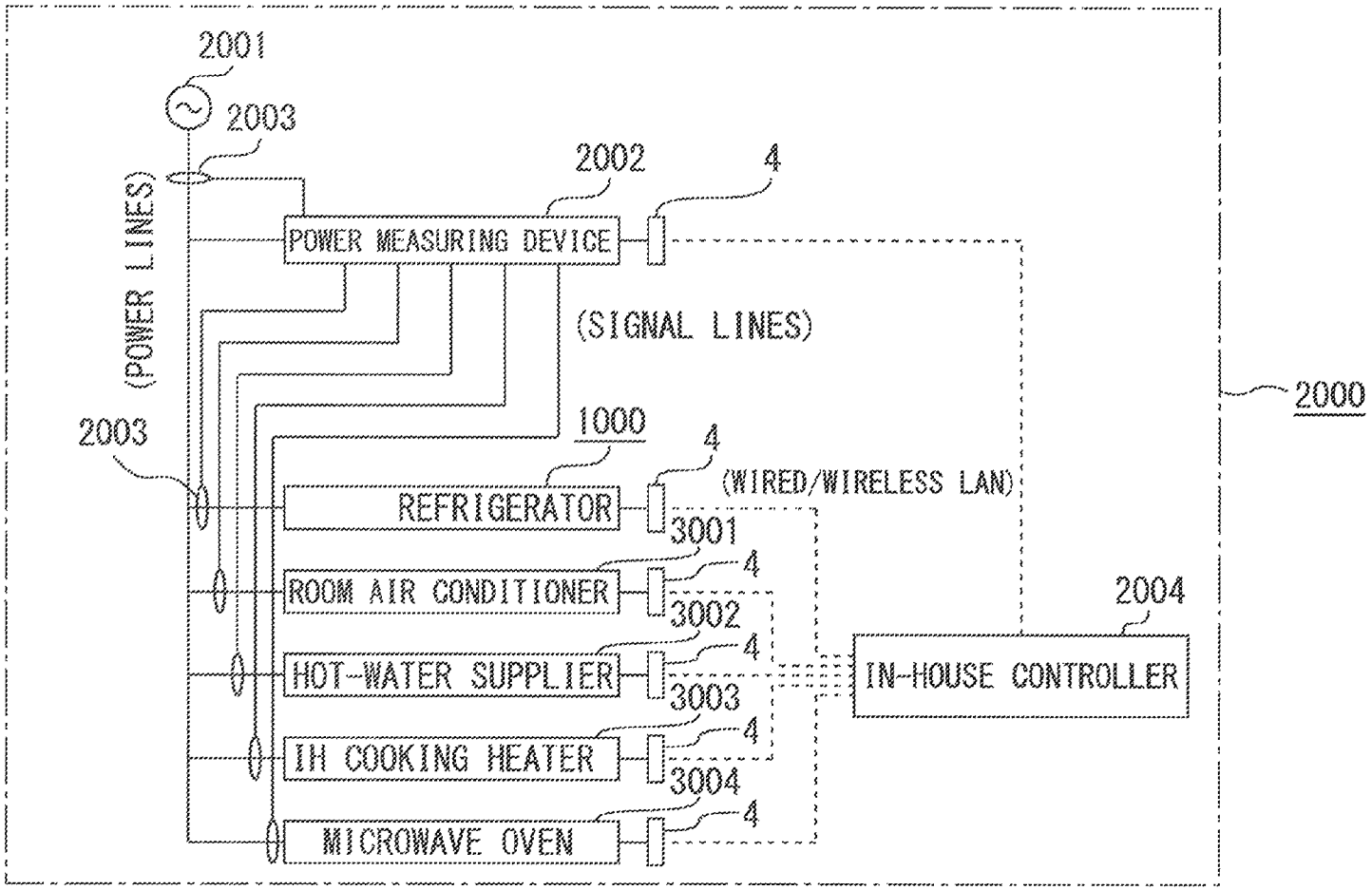
FIG. 20 is a block diagram of an in-house system (refrigerator management system) of a third embodiment of the present invention.

FIG. 20 is a block diagram of an in-house system (refrigerator management system) 2000 of a third embodiment of the present invention. It is to be noted that details not particularly mentioned in the third embodiment are identical to those in the first or second embodiment and that like functions or structure are designated by like reference signs.

As illustrated in FIG. 20, the in-house system (refrigerator management system) 2000 includes: a refrigerator 1000; one or a plurality of other electric appliances used in a residence having the refrigerator 1000 installed therein; a power measuring device 2002; and an in-house controller 2004. Although four electric appliances including a room air conditioner 3001, a hot-water supplier 3002, an IH cooking heater 3003, and a microwave oven 3004 are illustrated as other electric appliances used in the residence having the refrigerator 1000 installed therein in FIG. 20, the refrigerator management system of the present invention may include at least one electric appliance other than the refrigerator 1000 used in the residence having the refrigerator 1000 installed therein. In the following description, the refrigerator 1000, the room air conditioner 3001, the hot-water supplier 3002, the IH cooking heater 3003, and the microwave oven 3004 may generically be referred to as home electric appliances 1000 and 3001 to 3004 for convenience of description. The home electric appliances 1000 and 3001 to 3004, and the power measuring device 2002 are each connected with a grid power 2001 through power lines to receive power from the grid power 2001.

The power measuring device 2002 can gather information on the power supplied to each of the home electric appliances 1000 and 3001 to 3004 (power consumption to be more precise), and information on all the power supplied from the grid power 2001 by using a power measurement terminal 2003 such as a current transformer (CT). The power measuring device 2002 can store record of the gathered information.

Each of the home electric appliances 1000 and 3001 to 3004, and the power measuring device 2002 incorporate a communication means 4 for performing two-way communication with an in-house controller (which may simply be called a controller) 2004 in a wired or wireless manner, or are connected to an outside. The communication means 4 includes, for example, a serial interface or a driver in the case of performing wired communication. The communication means 4 includes a communication module, such as Wi-Fi (registered trademark) and Bluetooth (registered trademark), in the case of performing wireless communication.

The in-house controller 2004 manages information on the power consumption of each of the home electric appliances 1000 and 3001 to 3004 and the power supplied from the grid power 2001 received from the power measuring device 2002, and information on the operating state received from each of the home electric appliances 1000 and 3001 to 3004. The in-house controller 2004 can transmit a control change command to each of the home electric appliances 1000 and 3001 to 3004 based on the managed information.

Figure 21:
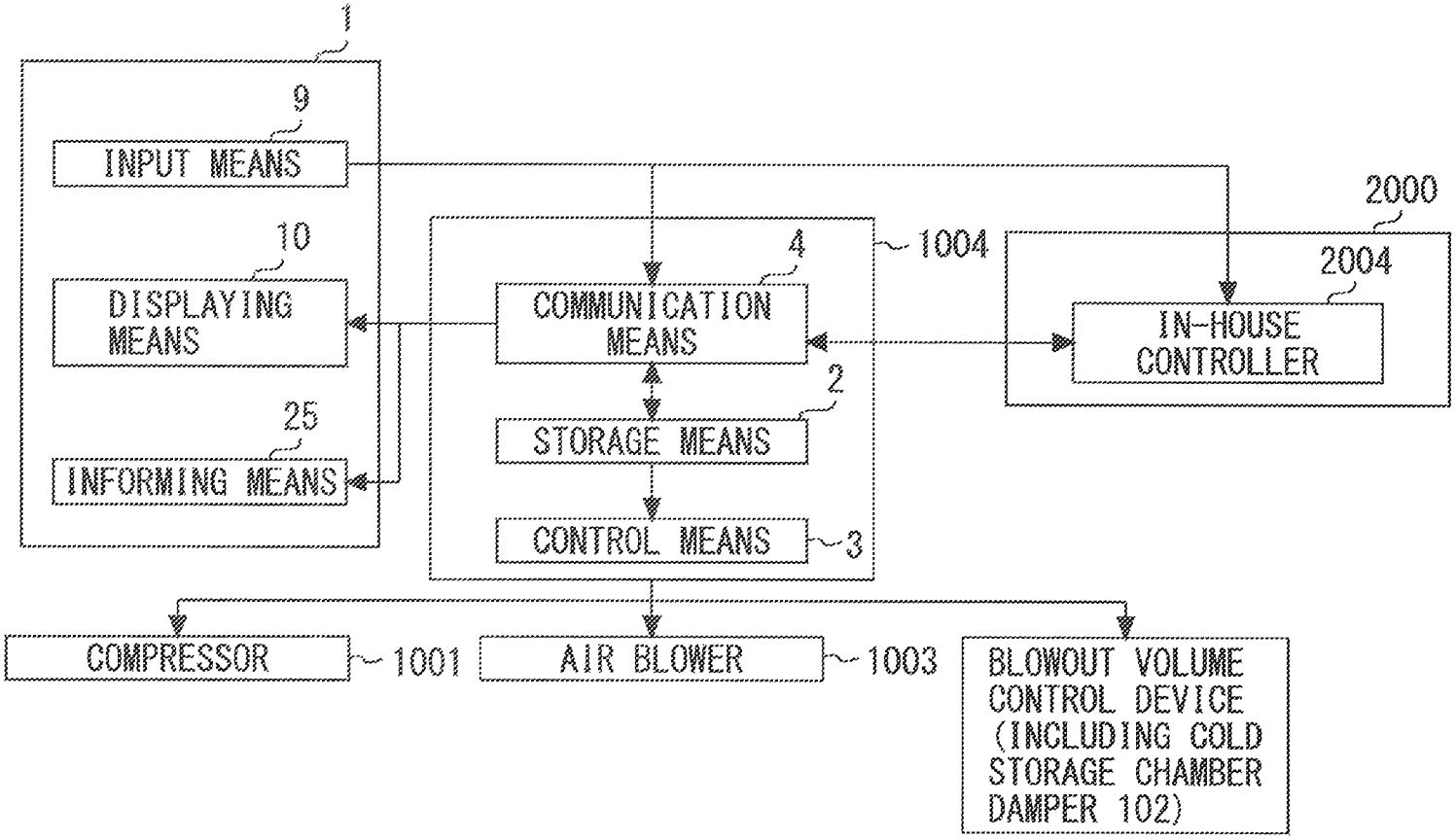
FIG. 21 is a functional block diagram of a refrigerator and an in-house controller of the third embodiment of the present invention.

FIG. 21 is a functional block diagram of the refrigerator 1000 and the in-house controller 2004 of the third embodiment of the present invention. In FIG. 21, the controller 1004 of the refrigerator 1000 has the communication means 4 illustrated in FIG. 20 as well as the storage means 2 and the control means 3. The communication means 4 is connected with the storage means 2, the input means 9, and the in-house controller 2004. The communication means 4 transmits the operating state (for example, power consumption information) of the refrigerator 1000 to the in-house controller 2004. The communication means 4 is configured to be able to receive the power information (for example, power consumption information) on other home electric appliances 3001 to 3004 from the in-house controller 2004 or a control change command which changes control of the refrigerator 1000, to transmit the power information to the displaying means 10 of the operation panel 1 via the storage means 2, and to transmit the control change command to the control means 3.

The operation panel 1 (including the input means 9 and the displaying means 10) is not limited to be provided on the door of the cold storage chamber 100 or the doors of other storage chambers. The operation panel 1 may be provided separately from the main body of the refrigerator 1000. In that case, both or one of the input means 9 and the displaying means 10 of the operation panel 1 may be configured to be attachable to or detachable from the main body of the refrigerator 1000. Or both or one of the input means 9 and the displaying means 10 of the operation panel 1 may be configured to be unmountable on the main body of the refrigerator 1000. For example, the operation panel 1 may be a tablet terminal which can wirelessly communicate through the communication means 4. Furthermore, the input means 9 and the displaying means 10 of the operation panel 1 may be provided separately from each other. One of the input means 9 and the displaying means 10 may be provided in the main body of the refrigerator 1000, and the other may be provided separately from the main body of the refrigerator 1000.

Now, a description is given of one example of operation with reference to FIGS. 20 and 21. The description of the operation described in the first or second embodiment will be omitted.

In FIG. 20, each of the home electric appliances 1000 and 3001 to 3004 operate with the power supplied from the grid power 2001. Each of the home electric appliances 1000 and 3001 to 3004 transmits, through the communication means 4, information on their operating states to the in-house controller 2004 in wired or wireless communication in a continuous manner or in response to request. Examples of the information on the operating state in the refrigerator 1000 include set temperatures of the storage chambers, record of actual temperatures inside the storage chambers, operation modes such as presence of ice making operation or rapid cooling operation, and alert information such as an empty state of a feed water tank and opened states of the doors.

In this case, currents supplied to each of the home electric appliances 1000 and 3001 to 3004 are measured with the power measurement terminal 2003, the power consumption of each of the home electric appliances 1000 and 3001 to 3004 and the power supplied from the grid power 2001 are calculated in the power measuring device 2002, and the power information is transmitted by the communication means 4 to the in-house controller 2004 through wired or wireless communication.

The in-house controller 2004 manages information on the power consumption of each of the home electric appliances 1000 and 3001 to 3004 and the power supplied from the grid power 2001 received from the power measuring device 2002, and information on the operating state received from each of the home electric appliances 1000 and 3001 to 3004. Based on these pieces of information, the in-house controller 2004 transmits a control change command to each of the home electric appliances 1000 and 3001 to 3004.

For example, when the total power consumption of the home electric appliances 1000 and 3001 to 3004 is close to supply capacity from the grid power 2001, the in-house controller 2004 transmits a power-saving command to a home electric appliance or appliances with particularly large power consumption. When it is determined that the refrigerator 1000 is overcooled based on records of the set temperatures of the storage chambers and actual temperatures inside the storage chambers, the in-house controller 2004 can give a command to increase the set temperatures.

For the refrigerator 1000 itself illustrated in FIGS. 20 and 21, the storage means 2 can change the set temperature of each of the storage chambers as in the first embodiment by sending a control change command to the control means 3 which controls the compressor 1001, the air blower 1003, and the blowout volume control devices, based on the schedule information on the users input in the input means 9 of the operation panel 1.

In the third embodiment, the controller 1004 of the refrigerator 1000 is configured to be able to receive, from the in-house controller 2004, information received from the power measuring device 2002 such as power consumption information and operation information on each of the home electric appliances 1000 and 3001 to 3004 in the in-house system 2000 and information on the power supplied from the grid power 2001, through the communication means 4.

Figure 22:
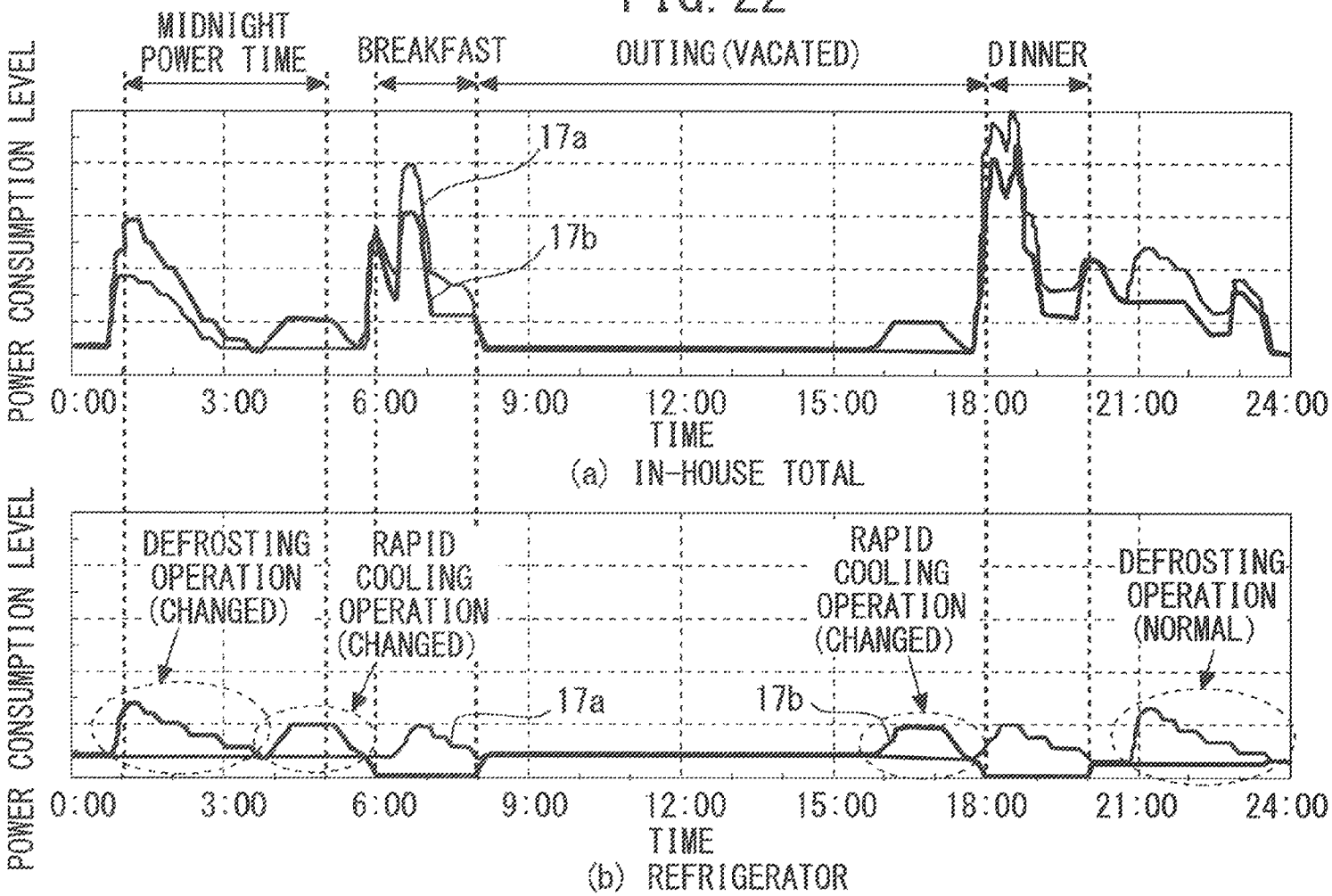
FIG. 22 illustrates one example of record data indicating a power consumption level of each of home electric appliances in the in-house system in the third embodiment of the present invention.
Figure 23:
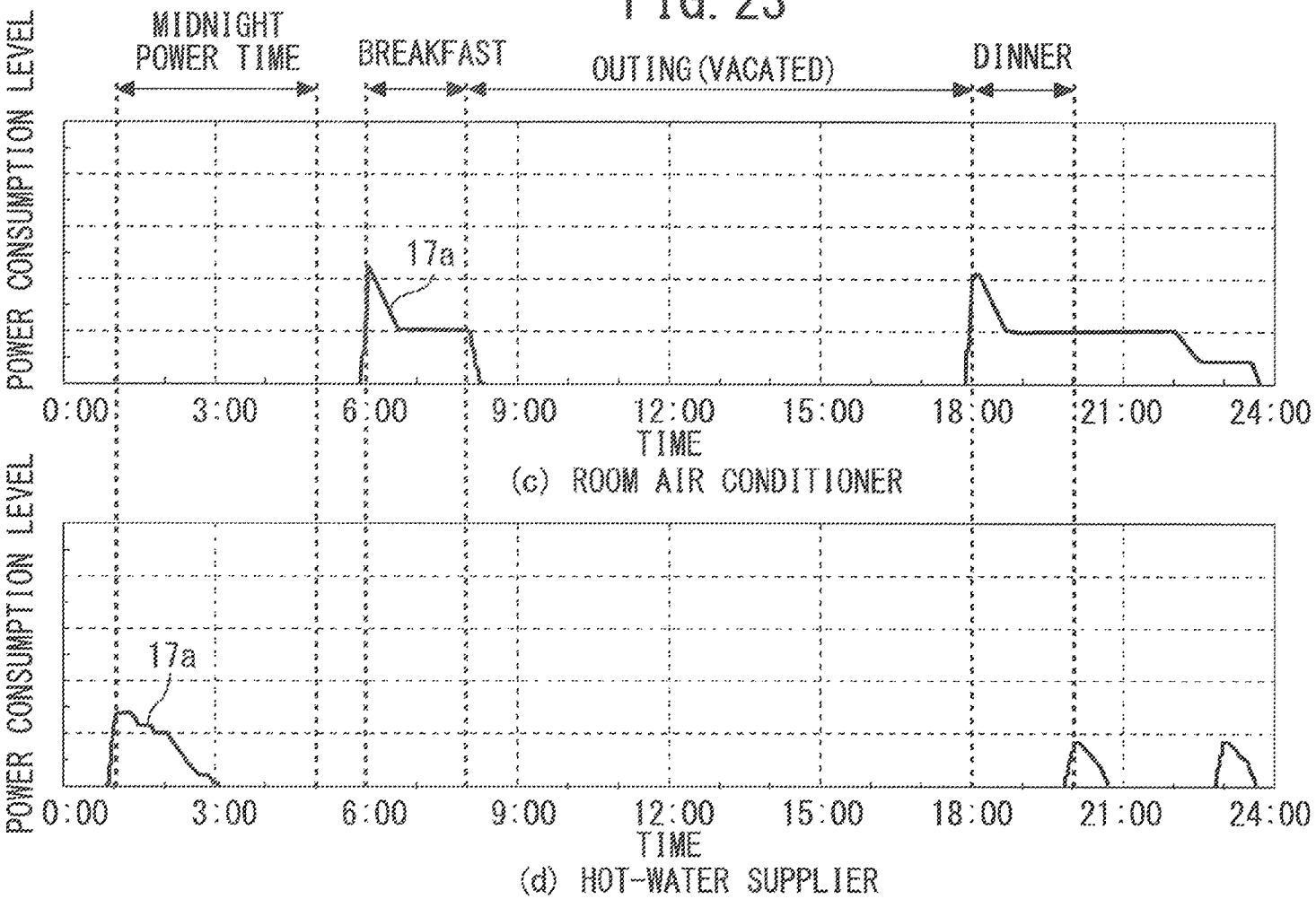
FIG. 23 illustrates one example of record data indicating a power consumption level of each of home electric appliances in the in-house system in the third embodiment of the present invention.
Figure 24:
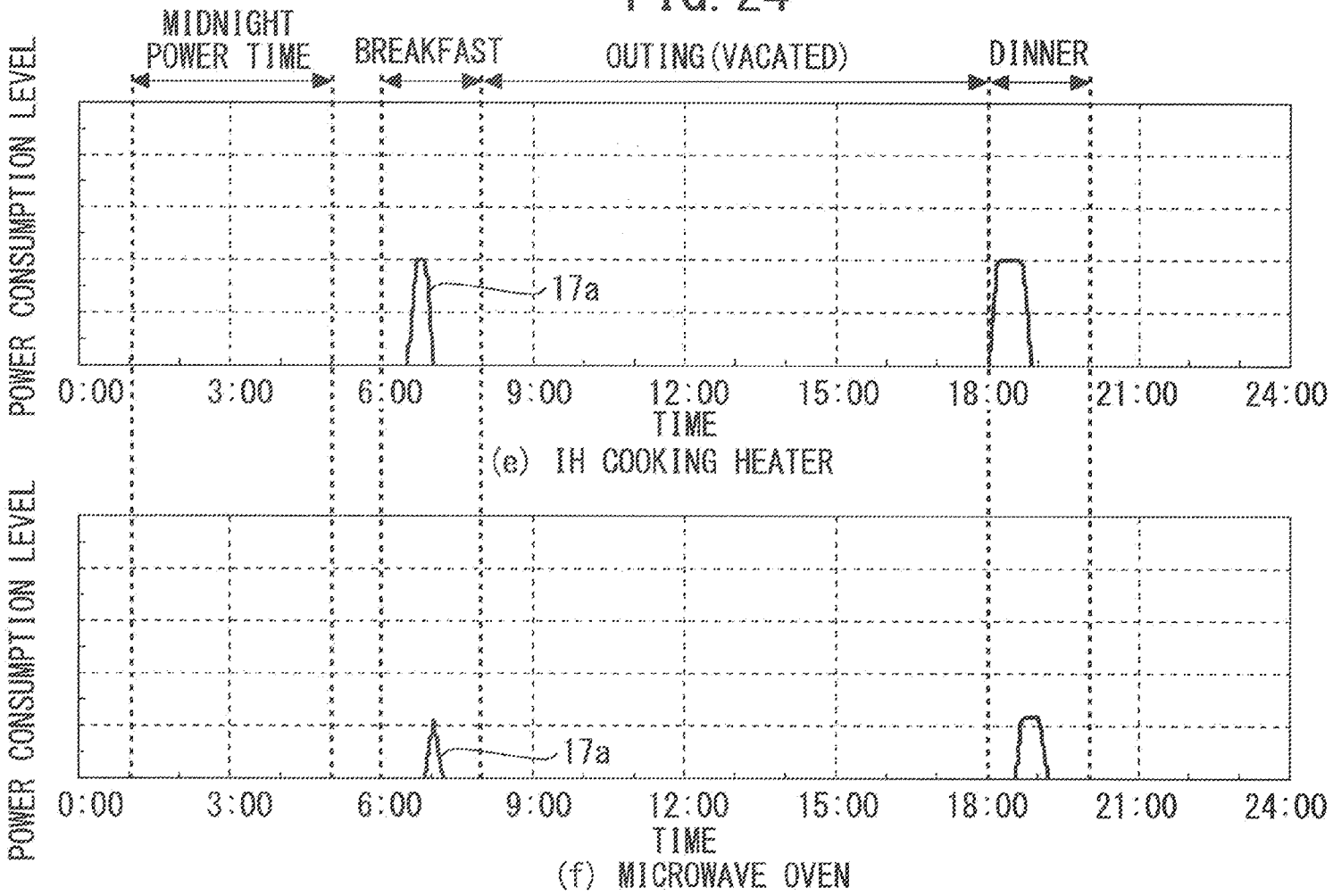
FIG. 24 illustrates one example of record data indicating a power consumption level of each of home electric appliances in the in-house system in the third embodiment of the present invention.

FIGS. 22 to 24 illustrate one example of record data indicating a power consumption level of each of the home electric appliances 1000 and 3001 to 3004 in the in-house system 2000 in the third embodiment of the present invention.

FIGS. 22 to 24 illustrate imitated daily record data on a power consumption level of each of the home electric appliances 1000 and 3001 to 3004 measured by the power measuring device 2002 in the in-house system 2000 illustrated in FIG. 20 and a total power consumption level of the in-house system 2000. More specifically, FIGS. 22(*a*) corresponds to the total level of the in-house system 2000, and FIGS. 22(*b*), 23(*c*), 23(*d*), 24(*e*), and 24(*f*) correspond to the levels of the refrigerator 1000, the room air conditioner 3001, the hot-water supplier 3002, the IH cooking heater 3003, and the microwave oven 3004, respectively.

In FIGS. 22 to 24, there are imitation data 17*a* and 17*b* of the records of power consumption levels measured by the power measuring device 2002. More specifically, the imitation data 17*a* indicates record of the power consumption level during normal operation, and the imitation data 17*b* indicates record of the power consumption level after change in cooling control of the refrigerator 1000. It is assumed that the in-house system 2000 is installed in the residence of a double-income household which is vacated in the daytime (8:00 to 18:00) as in the case of FIGS. 4 to 6.

As illustrated in FIG. 24, the power consumption level of the IH cooking heater 3003 and the microwave oven 3004, which are used for cooking, increases suddenly at breakfast time (6:00 to 8:00) and at dinner time (18:00 to 20:00).

As illustrated in FIG. 23(*c*), the room air conditioner 3001 is started at the time when users awake, which overlaps with the breakfast time. The room air conditioner 3001 is also started at the time when the users come back home, which overlaps with the dinner time. The power consumption level of the room air conditioner 3001 rapidly increases at these times of startup, and then steady operation continues at a relatively low power consumption level. As illustrated in FIG. 23(*d*), the power consumption level of the hot-water supplier 3002 slightly increases at the time of bathing at night. In addition, the hot-water supplier 3002 heats water to be accumulated at midnight hours, which causes increase in power consumption level.

As illustrated in FIG. 22(*b*), the doors of the refrigerator 1000 are frequently opened and closed at breakfast time and dinner time. At these periods of time, rapid cooling operation is operated to avoid temperature increase, so that the power consumption level 17*a* at the time of normal operation goes up. Due to the above-described circumstances, as illustrated in FIG. 22(*a*), the total power consumption level 17*a* of the in-house system 2000 during normal operation increases intensively at the breakfast time and at the dinner time.

Furthermore, in FIG. 22(*b*), defrosting operation is assumed to be executed in the refrigerator 1000 at night (21:00 to 23:00). When the defrosting operation overlaps with the breakfast time or the dinner time, there is a high possibility that power supply is under stress.

In that case, the in-house controller 2004 receives from the power measuring device 2002 the power consumption information on each of the home electric appliances 1000 and 3001 to 3004 and the information on power supplied from the grid power 2001. When the total power consumption of the home electric appliances 1000 and 3001 to 3004 is close to the supply capacity from the grid power 2001, the in-house controller 2004 transmits a power-saving command to each of the home electric appliances 1000 and 3001 to 3004 through the communication means 4.

For example, it is difficult for the IH cooking heater 3003 and the microwave oven 3004 which are in use for cooking to accept the power-saving command at breakfast time and at dinner time. However, the refrigerator 1000 and the room air conditioner 3001, which do not need to perform high power-consumption operation in that period of time, can perform power-saving operation.

Accordingly, in the refrigerator 1000, in the case where, for example, the door of the cold storage chamber 100 is frequently opened and closed at breakfast time or at dinner time, the control means 3 transmits signals for cancelling the rapid cooling operation and shifting to cooling reduction control operation, for increasing the opening ratio of the cold storage chamber damper 102 while decreasing the opening ratio of the damper for another storage chamber different from the cold storage chamber 100, and for decreasing the rotation speed of the compressor 1001 and the air blow volume of the air blower 1003, so that the cooling air intensively flows into the cold storage chamber 100. This makes it possible to reduce the power consumption level of the refrigerator 1000 and the total power consumption level of the in-house system 2000 at breakfast time and at dinner time as indicated by the power consumption level 17*b* after change in cooling control in FIG. 22.

Figure 25:
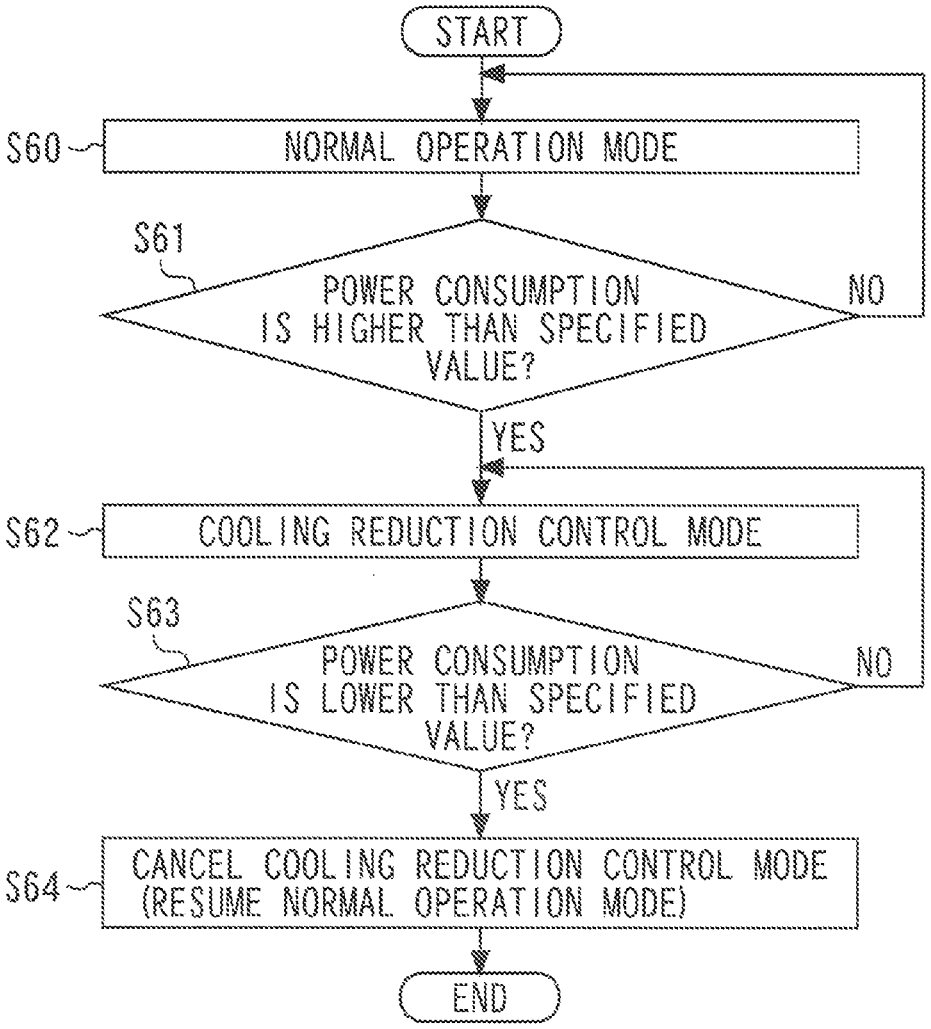
FIG. 25 is a flowchart illustrating control of the refrigerator included in the in-house system in the third embodiment of the present invention.

FIG. 25 is a flowchart illustrating control of the refrigerator 1000 included in the in-house system 2000 in the third embodiment of the present invention. Specific control procedures of the refrigerator 1000 when a power-saving command is sent to the refrigerator 1000 while the refrigerator 1000 is in the normal cooling operation mode will be described in detail with reference to the flowchart of FIG. 25.

In step S60, the refrigerator 1000, which is in a normal cooling mode, performs operation to normally cool a storage chamber (such as the cold storage chamber 100). During the normal cooling operation, the control means 3 or the in-house controller 2004 receives the power consumption information on each of the home electric appliances 1000 and 3001 to 3004, and determines whether or not the total power consumption is higher than a specified value that is set in advance (step S61).

For example, the power consumption is higher than the specified value in a time period when each of the home electric appliances 1000 and 3001 to 3004 is intensively used, so that the total power consumption of the home electric appliances 1000 and 3001 to 3004 becomes 90% or more of the supply power from the power source (the grid power 2001 in this case). The specified value, which is 90% of the supply power from the power source, may be more than 90%, or less than 90%. The power source is not limited to the grid power 2001. Any one of other power sources, such as a solar power generation device and a storage battery, may be used as the power source, or power may be supplied from a combination of a plurality of power sources.

When the control means 3 or the in-house controller 2004 determines that the total power consumption of the home electric appliances 1000 and 3001 to 3004 is lower than the specified value in a result of the determination (NO in step S61), the processing returns to the first step S60. More specifically, the refrigerator 1000 continues the normal cooling operation mode.

On the contrary, when the control means 3 or the in-house controller 2004 determines that the total power consumption of the home electric appliances 1000 and 3001 to 3004 is higher than the specified value (YES in step S61), the processing proceeds to step S62. In step S62, the refrigerator 1000 sets the cooling reduction control mode which reduces cooling of the cold storage chamber 100 (step S62).

In the cooling reduction control mode herein, as in the aforementioned cooling reduction control mode, a set inside temperature of the cold storage chamber 100 is increased by 2° C. for example, and the inside temperature of the cold storage chamber 100 is controlled to maintain the increased set temperature.

Next, the control means 3 or the in-house controller 2004 determines whether or not the total power consumption of the home electric appliances 1000 and 3001 to 3004 is lower than the specified value (step S63).

When the control means 3 or the in-house controller 2004 determines that the total power consumption of the home electric appliances 1000 and 3001 to 3004 is higher than the specified value in a result of the determination (NO in step S63), the processing returns to step S62 and the cooling reduction control mode is continued.

On the contrary, when the control means 3 or the in-house controller 2004 determines that the total power consumption of the home electric appliances 1000 and 3001 to 3004 is lower than the specified value (YES in step S63), the processing proceeds to step S64. In step S64, the refrigerator 1000 cancels the cooling reduction control mode to resume the normal cooling operation mode, and sets the set temperature of the storage chamber set before starting the cooling reduction control mode.

As described in the foregoing, when the power consumption of the home electric appliances 1000 and 3001 to 3004 in the residence is close to the supply power from the power source of the residence, a power-saving command can be issued to the refrigerator 1000 to perform control which reduces cooling of the refrigerator 1000. This makes it possible to provide an effect of reducing the power consumption as a result of the power-saving effect of the refrigerator 1000.

Figure 26:
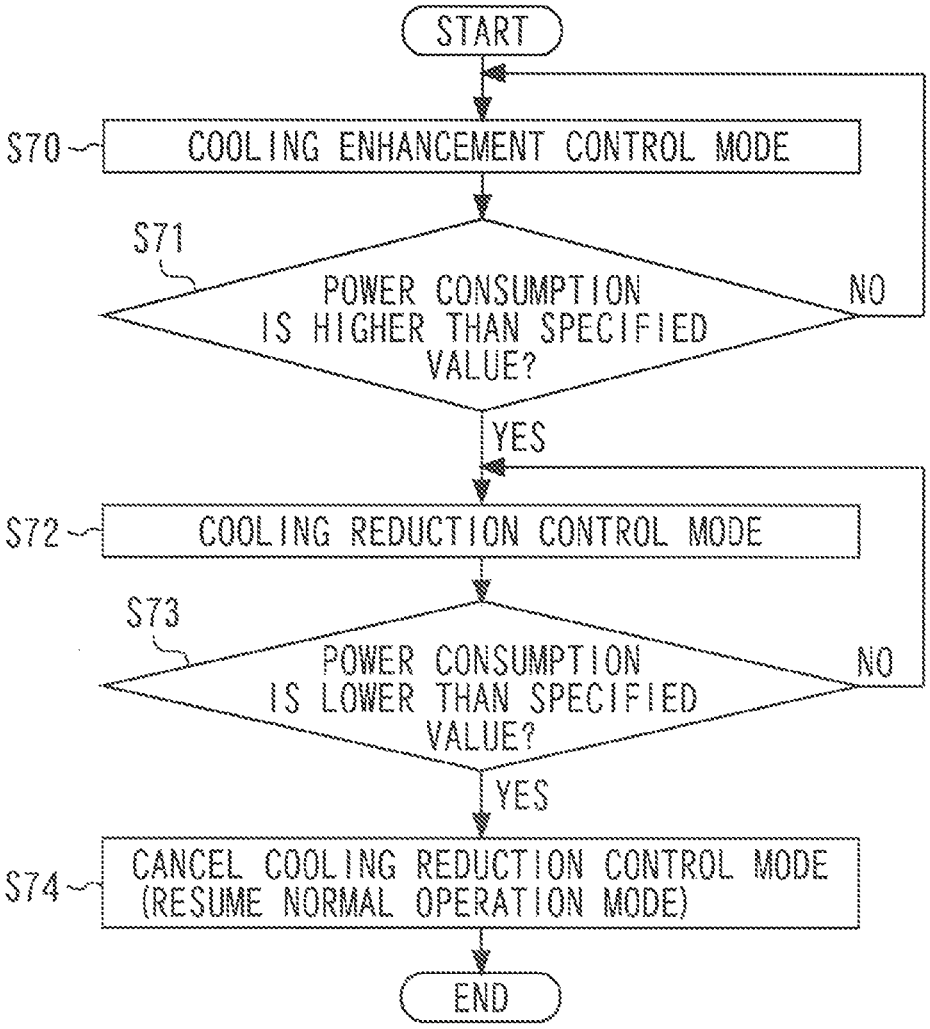
FIG. 26 is a flowchart illustrating control of the refrigerator included in the in-house system in the third embodiment of the present invention.

FIG. 26 is a flowchart illustrating control of the refrigerator 1000 included in the in-house system 2000 in the third embodiment of the present invention. Specific control procedures of the refrigerator 1000 when a power-saving command is sent to the refrigerator 1000 and the refrigerator 1000 is in the cooling enhancement control mode (rapid cooling operation) will be described in detail with reference to the flowchart of FIG. 26.

In step S70, the refrigerator 1000, which is in a cooling enhancement control mode, performs rapid cooling operation to enhance cooling of a storage chamber (such as the cold storage chamber 100). During the rapid cooling operation, the control means 3 or the in-house controller 2004 receives the power consumption information on each of the home electric appliances 1000 and 3001 to 3004, and determines whether or not the total power consumption is higher than a specified value that is set in advance (step S71).

For example, the power consumption is higher than the specified value in a time period when each of the home electric appliances 1000 and 3001 to 3004 is intensively used, so that the total power consumption of the home electric appliances 1000 and 3001 to 3004 becomes 90% or more of the supply power from the power source (the grid power 2001 in this case). The specified value, which is 90% of the supply power from the power source, may be more than 90%, or less than 90%. The power source is not limited to the grid power 2001. Any one of other power sources, such as a solar power generation device and a storage battery, may be used as the power source, or power may be supplied from a combination of a plurality of power sources.

When the control means 3 or the in-house controller 2004 determines that the power consumption of each of the home electric appliances 1000 and 3001 to 3004 is lower than the specified value in a result of the determination (NO in step S71), the processing returns to the first step S70. More specifically, the refrigerator 1000 continues the cooling enhancement control mode.

On the contrary, when the control means 3 or the in-house controller 2004 determines that the total power consumption of the home electric appliances 1000 and 3001 to 3004 is higher than the specified value (YES in step S71), the processing proceeds to step S72. In step S72, the refrigerator 1000 sets the cooling reduction control mode which reduces cooling of the cold storage chamber 100 (step S72).

Here, since the cold storage chamber 100 has been operated in the cooling enhancement control mode before determination in step S71, the cooling enhancement control mode (rapid cooling operation) applied to the cold storage chamber 100 is cancelled first, and then control to shift to the cooling reduction control mode is performed.

In the cooling reduction control mode herein, control is performed to increase the set temperature of another storage chamber different from the cold storage chamber 100 (for example, increase by 2° C.) without increasing the set temperature of the cold storage chamber 100. Specific control is as follows. That is, the opening ratio of the cold storage chamber damper 102 is increased while the opening ratio of the damper for another storage chamber, which is different from the cold storage chamber 100, is decreased, and the rotation speed of the compressor 1001 and the air blow volume of the air blower 1003 are decreased, so that the cooling air intensively flows into the cold storage chamber 100.

Next, the control means 3 or the in-house controller 2004 determines whether or not the total power consumption of the home electric appliances 1000 and 3001 to 3004 is lower than the specified value (step S73).

When the control means 3 or the in-house controller 2004 determines that the total power consumption of the home electric appliances 1000 and 3001 to 3004 is higher than the specified value in a result of the determination (NO in step S73), the processing returns to step S72 and the cooling reduction control mode is continued.

On the contrary, when the control means 3 or the in-house controller 2004 determines that the total power consumption of the home electric appliances 1000 and 3001 to 3004 is lower than the specified value (YES in step S73), the cooling reduction control mode is canceled to resume the normal cooling operation mode, and the set temperature of the storage chamber set before starting the cooling reduction control mode is set (step S74).

As described in the foregoing, when the power consumption of the home electric appliances 1000 and 3001 to 3004 in the residence is close to the supply power to the residence, a power-saving command can be issued to the refrigerator 1000. Accordingly, even while the cold storage chamber 100 is in the cooling enhancement control mode, the influence of cooling in the cold storage chamber 100 can be minimized, so that a power-saving effect as the refrigerator 1000 can be obtained.

The control means 3 prepares power consumption prediction information indicating future power consumption of each of the home electric appliances 1000 and 3001 to 3004, based on the power consumption information on each of the home electric appliances 1000 and 3001 to 3004 received from the in-house controller 2004. The power consumption prediction information is prepared by analyzing the tendency of time and date when power consumption increases and time and date when the power consumption decreases, based on past power consumption information on each of the home electric appliances 1000 and 3001 to 3004. The power consumption prediction information may be prepared based on methods other than the above-stated prediction method, that is, the power consumption prediction information may be prepared based on any prediction method.

The control means 3 prepares a control schedule of the refrigerator 1000 which indicates an operation schedule of the refrigerator 1000 in future date and time, based on the schedule information on the users. The control means 3 may prepare the control schedule of the refrigerator 1000 based on prediction information about use frequency or use condition of the refrigerator 1000, which is predicted from door opening and closing information and the like, in addition to the schedule information on the users. The control means 3 may update or correct the prepared control schedule of the refrigerator 1000 based on the power consumption prediction information. For example, in a time period when predicted power consumption in the power consumption prediction information is higher than a specified value which is set in advance, the control means 3 may update or correct the control schedule of the refrigerator 1000 so that the original schedule is replaced with a schedule of performing cooling reduction control which reduces cooling of the storage chamber. In that case, even when cooling enhancement control which enhances cooling of the storage chamber is scheduled to be executed according to the schedule information on users and the like before being updated or corrected, the control means 3 updates or corrects the control schedule of the refrigerator 1000 so that cooling reduction control which reduces cooling of the storage chamber is scheduled to be executed in the time period when the predicted power consumption in the power consumption prediction information is higher than the specified value. When the control means 3 prepares, updates or corrects the control schedule of the refrigerator 1000, the control schedule of the refrigerator 1000 may be displayed on the displaying means 10 to inform the users of the schedule, so that the users confirm the content of the control schedule of the refrigerator 1000. Or the control means 3 may automatically control operation of the refrigerator 1000 without informing the content of the control schedule of the refrigerator 1000 to the users. Furthermore, whether or not the content of the control schedule of the refrigerator 1000 is informed to the users may arbitrarily be set by the users.

As described in the foregoing, when the power consumption of the home electric appliances 1000 and 3001 to 3004 is predicted, and the predicted power consumption is close to the supply power, the power consumption of the refrigerator 1000 can be reduced by reducing cooling of the refrigerator 1000. Moreover, a peak of the power consumption in the user residence can be cut, which can prevent the consumed power from exceeding the supply power as much as possible. When the predicted power consumption in the power consumption prediction information is higher than the specified value, the control means 3 may display the prediction on the displaying means 10 to inform the users of the prediction or to inform the users of the prediction by other informing means 25 such as voice. Accordingly, when the predicted power consumption is close to the supply power, the users can be informed of the necessity of power-saving, and be encouraged to take power-saving action.

The control means 3 may perform the following control during defrosting operation or rapid cooling operation of the refrigerator 1000 which causes increased power consumption. The control means 3 may predict timing of needing the defrosting operation or rapid cooling operation based on operating record of the defrosting operation or rapid cooling operation. As illustrated by the power consumption level 17*b* under the changed cooling control in FIG. 22, the control means 3 may execute defrosting operation or rapid cooling operation in advance in a time period when the power consumption level of other home electric appliances is small, especially in a midnight power time period when electric utility expense per unit power is low. As a result, it becomes possible to avoid concentration of power consumption of the home electric appliances 1000 and 3001 to 3004, and to reduce the electric utility expense by effective use of midnight power.

Here, as indicated by FIGS. 22 to 24, the power consumption of each of the home electric appliances 1000 and 3001 to 3004 has a close relationship with the presence or absence of the users, i.e., the schedule information on the users. Thus, in the third embodiment, the control means 3 controls at least one of the compressor 1001, the air blower 1003, and the blowout volume control devices based on the schedule information on the users input in the input means 9 of the operation panel 1 and the power consumption information on each of the home electric appliances 1000 and 3001 to 3004 received from the in-house controller 2004 through the communication means 4. As a result, the power-saving operation of the refrigerator 1000 can be performed in consideration of the power consumption information on each of the home electric appliances 3001 to 3004 other than the refrigerator 1000.

Thus, the schedule information on the users is compared with the power consumption information on each of the home electric appliances 1000 and 3001 to 3004 so as to detect, for example, a sudden change in schedule, a schedule input mistake in the input means 9 of the operation panel 1, or a life pattern that is difficult to determine based only on the schedule information, from the power consumption information. This makes it possible to support the schedules of the users more accurately. As a result, optimum cooling control free from overcooling and undercooling can be executed while the preservation quality of food and drink is maintained. The life pattern which is difficult to determine only based on the above-mentioned schedule information includes, for example, a case in which a user or users are present, though boxed lunch or door-to-door delivery foods and the like are used and so the home electric appliances for cooking are not used. When the power consumption of the home electric appliances 1000 and 3001 to 3004 of the entire residence is high, the power-saving operation of the refrigerator 1000 can be performed. In this case, not only the power-saving effect of the refrigerator 1000 but also the power-saving effect of the entire residence can be obtained.

In the configuration illustrated in FIG. 21, the control means 3 determines the details of the control change command based on the schedule information on the users input by the input means 9 of the operation panel 1 and the power consumption information on each of the home electric appliances 1000 and 3001 to 3004 received from the in-house controller 2004 through the communication means 4, and controls at least one of the compressor 1001, the air blower 1003, and the blowout volume control devices. However, the in-house controller 2004 may include part of the functions of the storage means 2 and the control means 3. The in-house controller 2004 may collectively manage the schedule information on the users and the information on power consumption and operation of each of the home electric appliances 1000 and 3001 to 3004, and may determine the details of the control change command to be transmitted to the control means 3.

When the schedule information on the users is collectively managed by the in-house controller 2004, the schedule information on the users may also be reflected upon control of other home electric appliances, and the configuration of the controller 1004 can be simplified for the refrigerator 1000 itself. More specifically, the in-house controller 2004 and the communication means 4 of the refrigerator 1000 can transmit and receive only the details of the control change command at the time of controlling the refrigerator 1000. Since they do not need to transmit and receive the power consumption information on each of the home electric appliances 1000 and 3001 to 3004 on a regular basis or in response to request, an effect of being able to reduce the communication load in the communication means 4 can be obtained. Moreover, since the communication load is reduced, reduction in communication failure may also be achieved.

The displaying means 10 of the operation panel 1 illustrated in FIG. 21 may display the temperature information on each of the storage chambers, the input schedule information on the users, and the details of control changed based on the schedule information on the users as in the first or second embodiment. The displaying means 10 can further display the information on the power supplied from the grid power 2001 and the power consumption of each of the home electric appliances 1000 and 3001 to 3004, the power consumption prediction information on each of the home electric appliances 3001 to 3004, and the power consumption information on the refrigerator 1000, which are received through the communication means 4 and kept in the in-house controller 2004.

As described before, when a power supply and demand situation and the details of control corresponding thereto are displayed in addition to the schedule information on the users, it becomes possible to provide not only the effect of enabling the users to confirm the details of automatic control, but also the effect of being able to educate the users about power-saving action. Furthermore, when the operation panel 1 or the in-house controller 2004 is configured as a tablet terminal, the input means 9 and the displaying means 10 are provided in the tablet terminal with the communication means 4 enabling the tablet terminal to perform wireless communication, an effect of enabling the users to confirm the operation information and abnormal condition of the refrigerator 1000 from a long distance can be obtained. In addition, it becomes possible to provide an effect that a schedule can immediately be corrected from a long distance when a change of the schedule occurs.

In FIG. 20, currents supplied to each of the home electric appliances 1000 and 3001 to 3004 are measured with the power measurement terminal 2003, and the power consumption of each of the home electric appliances 1000 and 3001 to 3004 and the power supplied from the grid power 2001 are calculated in the power measuring device 2002. However, a power consumption measurement function may be mounted in each of the home electric appliances 1000 and 3001 to 3004, and the power consumption information may directly be transmitted from each of the home electric appliances 1000 and 3001 to 3004 to the in-house controller 2004 through the communication means 4. This makes it possible to eliminate the necessity of the power measuring device 2002 and the power measurement terminal 2003, and the in-house system 2000 is simplified. As a result, an effect of being able to construct the in-house system 2000 at low cost is obtained.

As described in the foregoing, in the third embodiment, the in-house controller 2004 of the in-house system 2000 makes it possible to acquire the power consumption information on each of the home electric appliances 1000 and 3001 to 3004 in the residence. Even when the power consumption of the home electric appliances 1000 and 3001 to 3004 is close to supply power, the refrigerator 1000 can be controlled so that effective power-saving can be performed. This makes it possible to achieve the power-saving effect and to contribute to reduction in peak power in the residence. It is obvious that the effects demonstrated in the first and second embodiments may also be demonstrated in the third embodiment.

The first to third embodiments of the present invention may not be individually configured, but the respective embodiments may be implemented in combinations. When the first to third embodiments are combined, the combined effects may also be achieved.

REFERENCE SIGNS LIST

1 operation panel
2 storage means
3 control means
4 communication means
5 storage chamber temperature detector
6 storage chamber pressure detector
7 cooling load estimation means
8 door opening and closing detection means
9 input means
10 displaying means
11*a* mark indicating that all users have schedules
11*b* mark representing a schedule of father (Taro)
11*e* mark representing a schedule of mother (Hanako)
11*d* mark representing a schedule of daughter (Kazumi)
11*e* mark representing a schedule of son (Kazuo)
12*a* mark representing a schedule of a travel
12*b* mark representing a schedule of a business trip
12*c* mark representing a schedule of a golf
12*d* mark representing a schedule of an eating out
12*e* mark representing a schedule of a swimming (lesson)
12*f* mark representing a schedule of a piano (lesson)
12*g* mark representing a schedule of a soccer (lesson)
13 mark representing current time
14*a* mark representing a time period scheduled for a business trip (irregular outing)
14*b* mark representing a time period scheduled for eating out (irregular outing)
15*a* mark representing a time period scheduled for work (regular outing)
15*b* mark representing a time period scheduled for school (regular outing)
16 mark representing a sleeping time period
17*a* record of power consumption level during normal operation
17*b* record of power consumption level after change in cooling control
21 power consumption of a refrigerator as a whole
22*a* mean temperature of the uppermost shelf of cold storage chamber
22*b* mean temperature of the second uppermost shelf of cold storage chamber
22*c* mean temperature of the third uppermost shelf of cold storage chamber
22*d* mean temperature of the lowermost shelf of cold storage chamber
23*a* mean temperature of upper door shelf of cold storage chamber
23*b* mean temperature of middle door shelf of cold storage chamber
23*c* mean temperature of lower door shelf of cold storage chamber
24 differential pressure between inside and outside of cold storage chamber
25 informing means
100 cold storage chamber
101 cold storage chamber return air duct
102 cold storage chamber damper
110 chilled room
111 chilled case
200 ice making chamber
300 switching chamber
400 freezing chamber
500 vegetable chamber
501 vegetable chamber return air duct
1000 refrigerator
1001 compressor
1002 cooler
1003 air blower
1004 controller
1010 cooling air duct
1020 return air duct
2000 in-house system
2001 grid power

2002 power measuring device
2003 power measurement terminal
2004 in-house controller
3001 room air conditioner
3002 hot-water supplier
3003 IH cooking heater
3004 microwave oven

The invention claimed is:

1. A refrigerator, comprising:

a main body having a storage chamber;

a refrigeration cycle device including a compressor and a cooler;

an air blower configured to blow cooling air cooled by the cooler to the storage chamber;

a damper configured to control a blowout volume of the cooling air to be blown out to the storage chamber;

a receiver configured to receive input of schedule information that is information about a schedule of a plurality of users;

a storage configured to store the schedule information received by the receiver; and a controller programmed to control at least one of the compressor, the air blower, and the damper based on the schedule information, wherein the schedule information includes information about at least one of a regular outing time period, information about an irregular outing time period, and information about a sleeping time period; the regular outing time period being scheduled as a time period of regular outing for each of the plurality of users, the irregular outing time period being scheduled as a time period of irregular outing for each of the plurality of users and the sleeping time period being scheduled as a sleeping time for each of the plurality of users, and wherein the controller is configured to reduce cooling of the storage chamber by decreasing at least one of a rotation speed of the compressor and an air blow volume of the air blower, based on the scheduled information indicating that part of the users are out or that part of the users are asleep.

2. The refrigerator according to claim 1, wherein the schedule information includes at least one of information about a life pattern of the plurality of users and information about a food and drink purchasing schedule of the plurality of users.

3. The refrigerator according to claim 1, comprising a door opening and closing detector configured to detect opening and closing of a door of the storage chamber, wherein the storage is configured to store door opening and closing information containing records about past door openings and closings detected by the door opening and closing detector, wherein the controller is programmed to include a normal cooling operation mode and a cooling reduction control mode, the cooling reduction control mode requiring a reduced amount of power consumption to cool the storage chamber that is less than an amount required in the normal cooling operation mode, wherein the controller is configured to:

operate in the regular outing time period in the regular outing time period based on the schedule information, operate in the irregular outing time period in the irregular outing time period based on the schedule information, operate in the sleeping time period in the sleeping time period based on the schedule information, wherein during operation in at least one of the regular outing time period and the sleeping time period normal operation mode, the controller is configured to determine that the door of the storage unit has been in a closed state for a predetermined time based on the door opening and closing information, and after the door of the storage unit has been closed for the predetermined time, the controller is configured to operate in the cooling reduction control mode by controlling at least one of the compressor, the air blower, and the damper.

4. The refrigerator according to claim 1, comprising a door opening and closing detector configured to detect opening and closing of a door of the storage chamber, and a temperature detector configured to detect a temperature inside the storage chamber, wherein the controller is programmed to include a normal cooling operation mode, a cooling reduction control mode and a cooling enhancement control mode, the cooling reduction control mode requiring a reduced amount of power consumption to cool the storage chamber that is less than an amount required in the normal cooling operation mode, and the cooling enhancement control increasing cooling load supplied to the storage chamber to decrease a temperature within the storage chamber compared with a normal cooling load supplied during the normal cooling operation mode, wherein the controller is configured to:

operate in the regular outing time period in the regular outing time period based on the schedule information, operate in the irregular outing time period in the irregular outing time period based on the schedule information, operate in the sleeping time period in the sleeping time period based on the schedule information, wherein during operation in the irregular outing time period, the controller is configured to:

operate in the cooling reduction control mode until a lower predetermined temperature inside the storage chamber is reached by controlling at least one of the compressor, the air blower, and the damper; and operate in the cooling reduction control mode after a continuation time of the door remains in a closed state reaches a predetermined time, the continuation time being measured from a point of time when an inside temperature of the storage chamber has lowered to the lower predetermined temperature under the cooling enhancement control mode.

5. The refrigerator according to claim 1, comprising a door opening and closing detector configured to detect opening and closing of a door of the storage chamber, wherein the controller is programmed to include a normal cooling operation mode and a cooling enhancement control mode, the cooling enhancement control increasing cooling load supplied to the storage chamber to decrease a temperature within the storage chamber compared with a normal cooling load supplied during the normal cooling operation mode, wherein the controller is configured to:

operate in the regular outing time period in the regular outing time period based on the schedule information, operate in the irregular outing time period in the irregular outing time period based on the schedule information, operate in the sleeping time period in the sleeping time period based on the schedule information, wherein during operation in the irregular outing time period, the controller is configured to:

operate in cooling enhancement control mode by controlling at least one of the compressor, the air blower, and the damper; and operate in the cooling reduction control mode after a continuation time of the door being in a closed state reaches a predetermined time during the cooling enhancement control mode, the continuation time being measured from a starting time when an inside temperature of the storage chamber has lowered to the predetermined temperature during the cooling enhancement control mode.

6. The refrigerator according to claim 1, wherein the controller is programmed to:

estimate a cooling load of the storage chamber; and perform, if the estimated cooling load is smaller than a predetermined determination and when a request for cooling reduction is present, a further reduction control mode for further reducing cooling operation of the storage chamber.

7. The refrigerator according to claim 6, wherein the controller is programmed to estimate the cooling load of the storage chamber based on at least one information out of information about inside temperature of the storage chamber, information about a volume of contents stored in the storage chamber, and information about opening and closing of the door of the storage chamber.

8. The refrigerator according to claim 6, comprising a display configured to display information, wherein the display is configured to display at least one information out of the schedule information, load information on the refrigeration cycle device, a set temperature of the storage chamber, power saving information on the refrigerator, and information on the cooling load of the storage chamber.

9. The refrigerator according to claim 1, wherein the controller is programmed to update the schedule information stored in the storage based on at least one record of information about inside temperature of the storage chamber, one record of information about a volume of contents stored in the storage chamber, and one record of information about opening and closing of the door of the storage chamber.

10. A refrigerator management system, comprising:

the refrigerator according to claim 1, the receiver and the main body of the refrigerator being separately provided; and a transmitter to transmit, via wireless communication, the schedule information received by the receiver to the storage of the refrigerator.

11. A refrigerator management system, comprising:

the refrigerator according to claim 1; and a transmitter to transmit information on power consumption of electric appliances to the controller of the refrigerator, the electric appliances being used in a residence having the refrigerator installed therein, wherein the controller is programmed to control at least one of the compressor, the air blower, and the damper so as to reduce cooling of the storage chamber when a value of the power consumption is higher than a predetermined value.

12. The refrigerator management system according to claim 11, wherein the controller is programmed to:

predict future power consumption based on the information on the power consumption; and control at least one of the compressor, the air blower, and the damper so as to reduce cooling of the storage chamber in a time period when a value of the predicted power consumption is higher than a predetermined value.

13. The refrigerator management system according to claim 11, comprising a display configured to display information, the display and the main body of the refrigerator being separately provided; and a transmitter configured to transmit the information about power consumption from the controller to the display via wired or wireless communication, wherein the display is configured to display the information about the power consumption.

14. A control method for a refrigerator, the refrigerator including: a main body having a storage chamber; a refrigeration cycle device including a compressor and a cooler; an air blower configured to blow cooling air cooled by the cooler to the storage chamber; a damper configured to control a blowout volume of the cooling air to be blown out to the storage chamber; and receiver configured to receive input of schedule information that is information about a schedule of a plurality of users, the control method comprising:

inputting the schedule information on the plurality of users into the receiver;

storing the schedule information received by the receiver; and controlling at least one of the compressor, the air blower, and the damper based on the schedule information, wherein the schedule information includes at least one of information about a regular outing time period and information about an irregular outing time period and information about a sleeping time period, the regular outing time period being scheduled as a time period of regular outing for each of the plurality for users, the irregular outing time period being scheduled as a time period of irregular outing for each of the plurality of users, the sleeping time period being scheduled as a sleeping time for each of the plurality of users, and wherein the control method comprises decreasing at least one of a rotation speed of the compressor and an air blower volume of the air blower when a quantity of users determined to be out increases or when a quantity of users determined to be asleep increases.

15. The refrigerator according to claim 1, wherein the controller is configured to reduce cooling of the storage chamber by decreasing at least one of a rotation speed of the compressor and an air blow volume of the air blower when a quantity of users scheduled to be on a regular outing increases, wherein the regular outing is based on the scheduled information.

* * * * *